US008309290B2

(12) United States Patent
Yamamoto et al.

(10) Patent No.: US 8,309,290 B2
(45) Date of Patent: Nov. 13, 2012

(54) TONER AND METHOD OF MANUFACTURING THE SAME

(75) Inventors: Atsushi Yamamoto, Kawanishi (JP); Chiyoshi Nozaki, Ohtsu (JP); Tsuyoshi Nozaki, Ikeda (JP); Mitsuyo Matsumoto, Ibaragi (JP); Takuya Kadota, Kobe (JP); Hiroyuki Murakami, Toyonaka (JP); Katsunori Kurose, Takarazuka (JP); Yoshimichi Ishikawa, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 1427 days.

(21) Appl. No.: 11/901,231

(22) Filed: Sep. 14, 2007

(65) Prior Publication Data

US 2008/0096119 A1 Apr. 24, 2008

(30) Foreign Application Priority Data

Sep. 15, 2006 (JP) ..... 2006-250885
Sep. 15, 2006 (JP) ..... 2006-251885

(51) Int. Cl.
*G03G 5/04* (2006.01)

(52) U.S. Cl. ..... 430/109.4; 430/110.2; 430/137.14

(58) Field of Classification Search ..... 430/109.4, 430/110.2, 137.14
See application file for complete search history.

(56) References Cited

U.S. PATENT DOCUMENTS

2004/0175641 A1* 9/2004 Nanya et al. ..... 430/109.4
2006/0057482 A1* 3/2006 Yuasa ..... 430/108.2
2006/0105258 A1* 5/2006 Ishiyama et al. ..... 430/108.4
2006/0110674 A1 5/2006 Maehata et al.
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.
2007/0092821 A1* 4/2007 Sato et al. ..... 430/108.4
2007/0122729 A1 5/2007 Katoh et al.
2007/0148568 A1 6/2007 Kadota et al.
2007/0166635 A1 7/2007 Yamamoto et al.
2007/0190442 A1* 8/2007 Nakamura et al. ..... 430/108.4
2007/0190443 A1 8/2007 Hagi et al.
2007/0207399 A1 9/2007 Kadota et al.
2008/0076054 A1* 3/2008 Nozaki et al. ..... 430/110.2

(Continued)

FOREIGN PATENT DOCUMENTS

JP 56-116042 9/1981

(Continued)

OTHER PUBLICATIONS

Japanese Patent Office, Communication (Dispatch No. 715750, dated Oct. 6, 2010) in Japanese Patent Application 2006-250885.

(Continued)

*Primary Examiner* — Mark F Huff
*Assistant Examiner* — Rachel Zhang
(74) *Attorney, Agent, or Firm* — Cooper & Dunham LLP

(57) ABSTRACT

A toner including toner particles comprising a binder resin, a coloring agent and a wax. The toner particles are prepared by agglomerating and/or fusing at least two kinds of resin particulates and particles of the coloring agent dispersed in an aqueous medium. A first resin particulate among the at least two kinds of resin particulates contains a resin having a polyester skeleton and the wax. At least 50% by weight of the binder resin is polyester resins.

15 Claims, 2 Drawing Sheets

U.S. PATENT DOCUMENTS

| | | | | |
|---|---|---|---|---|
| 2009/0035686 | A1* | 2/2009 | Sacripante | 430/110.2 |
| 2009/0047593 | A1* | 2/2009 | Vanbesien et al. | 430/110.2 |

FOREIGN PATENT DOCUMENTS

| | | |
|---|---|---|
| JP | 56-116043 | 9/1981 |
| JP | 59-83856 | 3/1984 |
| JP | 59-61842 | 4/1984 |
| JP | 60-238846 | 11/1985 |
| JP | 11-7156 | 1/1999 |
| JP | 11-143125 | 5/1999 |
| JP | 2002-82485 | 3/2002 |
| JP | 2002-148858 | 5/2002 |
| JP | 3456372 | 8/2003 |
| JP | 3577390 | 7/2004 |
| JP | 2004-271686 | 9/2004 |
| JP | 2004-271808 | 9/2004 |
| JP | 36-10231 | 10/2004 |
| JP | 2004-287149 | 10/2004 |
| JP | 2004-295105 | 10/2004 |
| JP | 2005-84183 | 3/2005 |
| JP | 2006-91379 | 4/2006 |
| JP | 2006-91564 | 4/2006 |
| JP | 2006-169509 | 6/2006 |
| JP | 2006-235383 | 9/2006 |

OTHER PUBLICATIONS

Japanese Patent Office, Communication (Dispatch No. 715752) in Japanese Patent Application 2006-250885.

* cited by examiner

TONER AND METHOD OF MANUFACTURING THE SAME

BACKGROUND

1. Technical Field

The present disclosure relates to a toner and a method of manufacturing the toner.

2. Discussion of the Background

Currently, there is a tendency of supersession from monochrome to full-color printing with regard to a photocopier, a printer, and a multi-function printer/peripheral/product (MFP), which functions as one apparatus including the function of a photocopier and a printer using electrophotography.

Among them, MFPs and printers installed in a small-sized office or distributed in an office have a large volume of shipments and are desired to be compact in size and inexpensive.

To satisfy these needs, the non-magnetic single component development process has an advantage in terms of the number of parts required. Further, an oil-free fixing process is adopted to dispense with an oil application mechanism and furthermore, it is preferred to adopt a cleaner-less system which can exclude a cleaning mechanism for an image bearing member, for example, a photoreceptor, and an intermediate transfer belt, if desired.

The non-magnetic single component development process is a method by which toner particles are frictionally charged by a toner layer regulating member contacting with a toner bearing member, thinly coated on the toner bearing member at the same time and transferred to the developing area where the toner bearing member opposes a latent electrostatic image bearing member to develop the latent electrostatic image on the latent image bearing member and visualize the image as a toner image.

In the non-magnetic single component development, toner is charged by friction between the toner and a toner layer regulating member. The toner layer regulating member contacts with the toner bearing member with a pressure in some degree to uniformly impart sufficient charge thereto. When development is continuously performed, problems arise such that toner cracks due to the pressure of a toner layer regulating member and toner and/or wax contained therein are fused and/or agglomerated and fixated on the surface of a toner bearing member, resulting in noise, for example, streak, and uneven density on a formed image.

As binder resins for use in toner, polyester resins, which are strong for mechanical stress caused by process, are advantageous and preferably used over an inexpensive styrene-acryl resins in terms of fixing property based on sharp melting property.

Toner used to be manufactured by the following method, which is to: mix a binder resin, for example, a polyester resin, with a coloring agent, wax and optional low molecular weight compounds or resins, for example, a charge controlling agent, a wax dispersing agent and a coloring agent dispersing agent, with a mixer, for example, HENSCHEL MIXER; melt, mix and knead the resultant with an two-axis extruder; pulverize the resultant at several stages to obtain color resin powder having a size of from several μm to several tens of μm; and adjust the size distribution thereof by air-classification. These are referred to as pulverized toner. However, pulverized toner is manufactured with an extremely large amount of energy in the pulverization process. To manufacture toner having a small particle diameter to restrain the consumption amount thereof and to improve the quality of images, this energy increases, which relates to a problem of burden on environment. With regard to quality, since it is difficult to control the dispersion of each material contained in toner, a fatal problem that wax exposes to the surface of a toner particle inevitably occurs. Therefore, pulverized toner has difficulty as toner for use in the oil-free fixing process.

To solve these problems, toner manufactured by various kinds of methods have been marketed in recent years instead of the pulverized toner.

For example, unexamined published Japanese patent applications Nos. (hereinafter referred to as JOP) H11-143125 and 2002-148858 describe a method for obtaining toner particles having a uniform shape, a sharp size distribution and a sharp charge amount distribution. There is, for example, a method of association (agglomeration and/or fusion) of resin particles obtained by emulsion polymerization method with coloring agent particles and wax particles. In this method, it is possible to obtain toner particles having a significantly spherical form. However, due to fragility of the styrene-acryl resin obtained by emulsion polymerization, toner particles tend to crack at the cohesion interface thereof by the pressure of a toner regulating member, resulting in deterioration of image quality.

Therefore, JOPs H11-7156 and 2004-271808 describe a method in which aqueous dispersion body of polyester particulate containing wax and a coloring agent is agglomerated and/or fused to obtain toner.

JOPs 2002-82485 and 2004-287149 describe a method in which polyester particulates, wax particulates and coloring agent particulates are agglomerated and/or fused in an aqueous medium to obtain toner.

JOPs 2006-91564 and 2006-91379 describe a method in which crystalline polyester particulates, wax particulates and coloring agent particulates are agglomerated in an aqueous medium, and non-crystalline polymer particulates are agglomerated to the agglomerated body to obtain toner particles.

The toners obtained by these methods are excellent in fixing property. However, it is found that toner cracking and contamination on peripheral devices occur while mixing and regulation are repeated in a developing device. This is probably because the wax and the polyester resin are not sufficiently adhered to each other and the toner cracks at the interface therebetween by the mechanical stress.

JOP 2004-295105 describes the following method: an oil phase in which a polyester resin, a styrene-acryl resin and wax are dissolved or dispersed in an organic solvent is prepared and poured in an aqueous phase containing a dispersing agent followed by stirring to finely-disperse the oil phase; and the organic solvent is removed to obtain liquid dispersion of resin containing wax followed by agglomeration and/or fusion. The resin particulates obtained here is desired to contain wax therein. However, wax is locally existent on the surface of a particle since the wax moves together with the solvent when the solvent is removed. Furthermore, phase separation of the polyester and the styrene-acryl occurs when the solvent is removed. Therefore, when this method is applied, the phase separation inside a toner particle causes deterioration of toner strength so that it is difficult to sufficiently prevent toner cracking.

Japanese patent No. 3456372 describes the following method: an oil phase in which polyester, a coloring agent and wax are dissolved or dispersed in an organic solvent is prepared and poured into an aqueous phase containing a dispersing agent followed by relatively gentle stirring to disperse the oil phase; and the organic solvent and the dispersing agent are removed followed by washing, drying and classifying to obtain toner. However, even the toner obtained by this method tends to crack or contaminates peripheral members when mixture and regulation are repetitively performed in a developing device. The polyester and the wax have a weak adhesion property at the interface therebetween, which is thought to be a trigger to cause toner particles to crack.

JOPS S36-10231, S59-53856 and S59-61842 describe the following method: an oil-soluble polymerization initiator, a coloring agent, wax, a charge controlling agent, etc., are dissolved or dispersed in a vinyl-based monomer; the resultant is suspended in an aqueous medium containing an organic and/or inorganic dispersing agent; and the resultant is heated for polymerization to obtain toner particles. This method is referred to as a suspension polymerization method and the concept thereof has been well known for a long time. However, the fragility of styrene-acryl resin obtained from polymerization of a vinyl-based monomer causes a problem due to the reason described above. It is possible to overcome the fragility by cross-linking a resin but this sacrifices the fixing property.

JOPS S56-116042, S56-116043, and S60-238846 describe a method in which polyester is dissolved or dispersed in a vinyl-based monomer to suspension polymerization toner containing polyester. However, there is a limit to the amount of polyester which can be dissolved in a vinyl based monomer. As described in the specifications of these JOPs, a preferred amount of the polyester is not greater than a half against the amount of vinyl based monomer. The toner obtained by these methods does not exploit the characteristics of polyester resin and cannot restrain the occurrence of toner cracking and contamination to peripheral members.

Consequently, toner having a good combination of the fixing property and durability has not been obtained by these methods described above.

In addition, with regard to electrophotography, various kinds of studies and development have been made with creativity and technology approaches. In electrophotography, a toner image is formed by the following process: charging and irradiating the surface of an image bearing member to form a latent electrostatic image; developing the latent electrostatic image with a color toner to form a toner image; transferring the toner image to a transfer medium (e.g., sheet); and fixing the toner image with a heat roller, etc.

As the method of fixing toner, a contact and heating fixing method, e.g., a heat roll method, has been widely adopted. A fixing device for use in such a heat roll fixing method includes a heat roller and a pressure roller. When a recoding medium bearing a toner image passes through the nipping portion of the heat roller and the pressure roller, the toner image is melted and fixed on the recording medium.

The viscosity of melted toner drastically decreases. Therefore, there is possibility that toner may attach to the heating roller (referred to as offset), a recording sheet is wound round the heating roller and not detached therefrom. To prevent the occurrence of these problems, there is a method of applying a lubricant, for example, silicone oil, to a roller. However, a device to apply a lubricant is required, which increases cost. Also the size of a fixing device increases. In addition, oil is attached to an image, resulting in formation of a glossy image. This makes writing impossible on the image with a pen, etc. To the contrary, there is a method of solving such drawbacks by containing a releasing agent (wax) inside toner particles. In this method, when toner is melted, releasing agent is melted and oozes from the inside of the toner so that attachment of toner to a heating roller can be prevented. The ideal function of such a releasing agent is to: (1) melt at a temperature as low as possible; (2) to melt with a small amount of heat; (3) to have a low fusion viscosity; (4) to securely and quickly move from the inside of a toner particle to the outer surface. When these functions are achieved, the required amount of releasing agent is small, the fixing temperatures can be low, the power consumption of a heating roller, etc., is small, the margin that can be utilized for increasing the system speed (printing speed) can be wide, etc. However, to achieve (1), when the fusion temperature (melting point) of such a releasing agent is too low, a problem may arise that toner containing the releasing agent melts inside an image forming apparatus, for example, a developing device, due to the environmental change and the temperature rise during driving of devices. Namely, there is a limit on simply decreasing the melting point of a releasing agent. In addition, to achieve (2), it greatly depends on the amount of a releasing agent contained in toner. A sufficient releasing effect is not obtained with a small amount of such a releasing agent. To the contrary, when the amount thereof increases, the required amount of heat increases and the releasing agent tends to be present close to or on the surface of toner particles. The condition of (3) depends on the kind of releasing agents. A releasing agent is desired to have a small intermolecular reaction and a low polarity in light of molecular structure. However, when the polarity in a releasing agent changes, the compatibility and interaction between the releasing agent and a binder resin in toner also change. The existing status and position of a releasing agent inside toner should be taken into account. With regard to (4), this highly depends on the existing position and status of a releasing agent inside a toner particle. When a releasing agent is present close to the center of a toner particle, it is difficult for such a releasing agent to quickly move to the surface of the toner particle when heated and melted for fixing. Therefore, it is desired that such a releasing agent is uniformly dispersed or present near the surface of a toner particle in a range in which there is no adverse impact on a developing device, etc. In addition, when the existing status (hereinafter referred to as domain) of a releasing agent is small (fine dispersion), the releasing agent is difficult to quickly move inside a toner particle when heated and melted. Furthermore, the extruding effect by transformation upon application of pressure is difficult to obtain. Especially, a spherical domain is a great disadvantage. Therefore, the domain form is desired to be a stick form or disk form.

As the resin for use in toner, a resin having a vinyl-based polymer resin and a resin having a polyester skeleton are suitably used. These resins have each own merits and demerits on fluidity, movability, chargeability, fixability and image characteristics. In recent years, both resins have been used in combination and/or a resin having both skeletons (referred to as hybrid resin) have been also used. With regard to the method of manufacturing toner, in addition to the typical method, i.e., the kneading and pulverization method, there are methods referred to as wet granulation method or chemical toner method, for example, a suspension method, an emulsifying method, a suspension polymerization method in which toner particles are directly obtained by polymerization while controlling polymerizable monomer droplets, and an agglomeration method in which emulsified particulates are prepared and agglomerated to obtain toner particles.

For example, JOP 2005-084183 describes a toner in which a coating layer formed of resin particles manufactured by an emulsifying polymerization method or an emulsifying dispersion method using a surface active agent covers the surface of a color resin particle manufactured by an emulsifying dispersion method and the core is a polyester-based resin and the coating layer is a vinyl-based resin. JOP 2004-295105 describes a toner manufactured through the process of agglomerating resin particles in an aqueous medium as follows: Prepare liquid dispersion in which a resin solution in which a polyester resin and a styrene-acryl based resin are dissolved in an organic solvent is dispersed in an aqueous medium; Remove the organic solvent from the liquid dispersion; and agglomerate resin particles in the aqueous medium. JOP 2004-271686 describes a toner manufactured as follows: Prepare resin particulates having a size of 1 μm from a polyester-based resin and carnauba wax by polyaddition reaction or polycondensation; Prepare liquid dispersion in which the resin particulates are dispersed in an aqueous medium; and curing salt-out and/or fusing the resin particulates in the liquid dispersion in the aqueous medium. In addition, Japanese Patent No. 3577390 describes a toner manufactured by preparing resin particulates having a size of 0.9 μm from a polyester-based resin and oxidization type polypropylene followed by agglomeration. Furthermore, JOP H11-007156 describes a toner manufactured as follows: Prepare a mixed solution by dissolving or dispersing a toner composition containing a binder resin using multiple polyester resins having different acid values or glass transition temperatures and a coloring agent in an organic solvent; and Introduce the mixed solution into an aqueous medium to manufacture resin particulates having a size of from 0.4 to 0.7 μm from the polyester-based resins and paraffin wax by suspension granulation followed by agglomeration.

These chemical toners have variety of advantages when compared with kneading and pulverization methods. For example, the resin structure can be controlled and the position of a releasing agent, etc., can be also controlled. However, the following is found: When a releasing agent is dispersed in a vinyl-based polymer resin in emulsification, both are compatible with each other, resulting in fine dispersion; In the case of emulsification polymerization, it is difficult to manufacture a large-sized particulate and therefore the domain is not large; With regard to the suspension polymerization, a releasing agent is dissolved in a monomer and a spherical domain is formed in the toner center; and when toner particles are directly granulated by a polyester dissolution suspension method, the releasing agent exposes to the surface of obtained toner particles.

As described above, with regard to the toner prepared by the chemical toner method, toner having excellent fixing properties which can deal with high speed printing as full, color toner while having a satisfactory function and characteristics has not been obtained. There is a need for an improved toner.

SUMMARY

The present disclosure describes a toner that has a sufficient chargeability and durability, can be fixed at a low temperature with a good combination of high temperature preservability, is free from offset to a fixing device without coating oil thereto, and is strong for stress in the developing process and a method of manufacturing the toner.

In one aspect of this disclosure, a toner is provided which comprises toner particles including a binder resin, a coloring agent and a wax. The toner particles are prepared by agglomerating and/or fusing at least two kinds of resin particulates and particles of the coloring agent dispersed in an aqueous medium. A first resin particulate among the at least two kinds of resin particulates contains a resin having a polyester skeleton and the wax. At least 50% by weight of the binder resin is polyester resins.

It is preferred that the first resin particulate is manufactured by dissolving a first polyester resin and the wax in a vinyl-based monomer, dispersing the solution in an aqueous medium comprising a surface active agent and polymerizing the vinyl-based monomer by a polymerization initiator, and a second resin particulate among the at least two kinds of resin particulates is a second polyester resin.

It is still further preferred that the first polyester resin has a polymerizable double bonding.

It is still further preferred that the first resin particulate is prepared by dispersing the wax in a solution in which at least the resin having the polyester skeleton is dissolved in an organic solvent, and suspending the resultant liquid dispersion in an aqueous medium.

It is still further preferred that the at least two kinds of resin particulates include a vinyl-based polymer resin.

It is still further preferred that the wax is a hydrocarbon wax.

It is still further preferred that at least one of the first polyester resin and the second polyester resin has a crystalline polyester.

It is still further preferred that the surface of the toner mentioned above is covered with an amorphous polymer.

It is still further preferred that the interface between the wax and the binder resin includes a mixture area of one or more of the polyester resins and a styrene-acrylic resin.

It is still further preferred that the first resin particulate has a volume average particle diameter greater than 1 μm and an endothermic amount measured by a differential scanning calorimeter (DSC) is 10 mJ/mg based on heat of fusion of the wax.

It is still further preferred that the domain of the wax has a stick form or a disk form.

It is still further preferred that the toner has an average circularity of not less than 0.965.

It is still further preferred that the resin particulates other than the first resin particulate have a volume average particle diameter of not greater than 0.2 μm.

It is still further preferred that the toner mentioned above has a core-shell structure in which the resin particulates other than the first resin particulate cover the surface of the toner.

It is still further preferred that, in the toner mentioned above, after agglomerating and/or fusing the at least two kinds of resin particulates dispersed in an aqueous medium to obtain a particle, the resin particulates other than the first resin particulate are agglomerated and/or fused on the particle.

It is still further preferred that the first resin particulate includes a modified polyester resin having at least one of a urethane group and a urea group.

It is still further preferred that one or more of the polyester resins contain a modified polyester resin either or both elongated or cross-linked according to a reaction between a modified polyester resin having an isocyanate group at an end thereof and an amine.

As another aspect of the present disclosure, a method of manufacturing a toner is provided in which the toner is manufactured by forming a solution by dissolving a first polyester resin and wax in a vinyl-based monomer, dispersing the solution in an aqueous phase containing a surface active agent, polymerizing the vinyl-based monomer with a polymerization initiator to obtain a liquid dispersion of resin, mixing the liquid dispersion of resin, another liquid dispersion in which a second polyester resin is dispersed in another aqueous phase, and a yet another liquid dispersion of coloring agent particles, adding an agglomerating agent to form agglomerated particles of the resin and the coloring agent particles and heating the agglomerated particles to unite.

These and other features and advantages of the subject matters of the present disclosure will become apparent upon consideration of the following description of the preferred embodiments of the present disclosure.

BRIEF DESCRIPTION OF THE DRAWINGS

Various other features and attendant advantages of the subject matter of the present disclosure will be more fully appreciated as the same becomes better understood from the detailed description when considered in connection with the accompanying drawings in which like reference characters designate like corresponding parts throughout and wherein.

DETAILED DESCRIPTION OF EXEMPLARY EMBODIMENTS

A toner in an exemplary embodiment of the present disclosure contains at least a binder resin, wax and a coloring agent and not less than 50% by weight of the binder resin, preferably the toner, is a polyester resin. In addition, the wax is contained inside a toner particle, and furthermore, there is a mixing area of polyester and styrene-acryl resin present on the surface of the wax. Therefore, there is no portion where the toner particle tends to crack when a mechanical stress is applied thereto. Thus, the toner particle does not deteriorate even when mixing and regulation are repetitively performed in a developing device.

In addition, as a specific method of obtaining the toner described above, for example, there is the following method containing an agglomeration process and uniting process: Liquid dispersion of resin is prepared by dissolving a first polyester resin and wax in a vinyl based monomer and dispersing the resultant in an aqueous phase containing a surface active agent followed by polymerization of the vinyl based monomer by an polymerization initiator; Liquid dispersion of another second polyester resin particulate (i.e., a second polyester resin) and liquid dispersion of a coloring agent are mixed with the liquid dispersion of resin; An agglomeration agent is added to the mixture to form an agglomerated particle of the binder resin particle and the coloring agent particle (agglomeration process); and the agglomerated particles is heated for unification (uniting process). In this method, the polyester resin and the styrene-acryl resin entirely or partially takes pseudo interpenetrating polymer network (IPN) by dissolving the polyester resin and the styrene-acryl resin in the vinyl-based monomer followed by polymerization of the vinyl-based monomer. Thus, the toner described above is obtained. In addition, by introducing a double bond reactive with the vinyl based monomer in the polyester resin, it is possible for the styrene-acryl resin to form covalent bonding with the polyester resin during polymerization of the vinyl based monomer so that the mixing area of the polyester chain and the styrene-acryl chain are actively formed. Namely, this is a suitable method to manufacture the toner described above.

Figure 1:
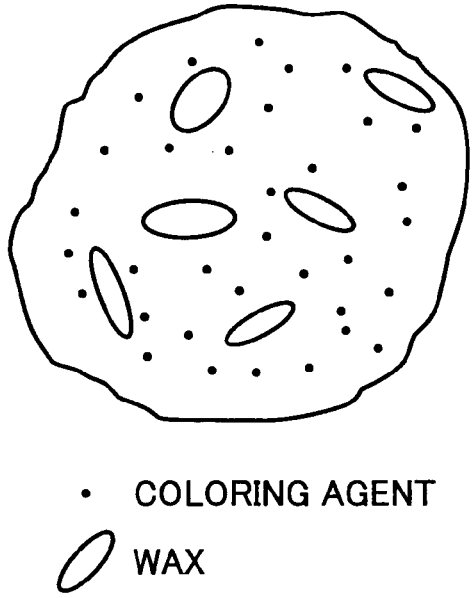
FIG. 1 is a cross section view illustrating a toner particle, according o an exemplary embodiment of the present disclosure.

FIG. 1 is a cross section view of the toner in am exemplary embodiment of the present disclosure. The resin forming the toner is formed by agglomeration and/or fusion of at least two kinds of resin particulates. Among these, wax contained in the first resin particulate having a polyester skeleton is present as a large domain, which has a stick form or a disk form. The domain is not locally present inside a toner particle and relatively dispersed therein. Thus, the domain does not expose to the surface of a toner particle.

The resin particulate containing wax of the present disclosure preferably a polyester-based resin. On the other hand, there is no specific limit to the other resin particulates and any resin can be used. For example, vinyl-based copolymer resins are easy to design resin characteristics (e.g., thermal characteristics and polarity). In addition, such a vinyl-based copolymer resin can be easily copolymerized with a polymerizable monomer having a particular functional group. Furthermore, it is easy to manufacture resin particulates from vinyl-based copolymer resin by emulsion polymerization. Considering these, vinyl-based copolymer resins are preferably used.

Polyester Resin

There is no specific limit to the kinds of the polyester resin for use in the subject matter of the present disclosure and any known polyester resins can be used. It is possible to mix several kinds of polyester resins for use. Specific examples of the polyester resins include polycondensations of the following polyol (1) and polycarboxylic acid (2).

Polyol

Specific examples of the polyol (1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (other name as tetrafluorobisphenol A), and 2,2-bis(3-hydroxyphenyl)-1,1,1,3,3,3-hexafluoropropane; bis(4-hydroxyphenyl)ethers (e.g., bis(3-fluoro-4-hydroxyphenyl)ether), adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide).

Furthermore, multi-valent aliphatic alcohols (e.g., glycerin, trimethylol ethane, trimethylol propane, pentaerythritol, sorbitol), tri- or higher valent phenols (such as trisphenol PA, Phenol novolac, cresol novolac) and adducts of the tri- or higher valent phenols mentioned above with alkylene oxides can be suitably used.

These polyols can be used alone or in combination and are not limiting.

Polycarboxylic Acid

Specific examples of polycarboxylic acid (2) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids, 3-fluoroisophthalic acid, 2-fluoroisophthalic acid, 2-fluoroterephthalic acid, 2,4,5,6-tetrafluoroisophthalic acid, 2,3,5,6-tetrafluoroisophthalic acid, 5-trifluoromethyl isophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and anhydride of hexafluoroisopropylidene diphthalic acid.

Among these, alkenylene dicarboxylic acids having 4 to 20 carbon atoms and aromatic dicarboxylic acids having 9 to 20 carbon atoms are preferred. Furthermore, specific examples of tri- or higher carboxylic acids include polycarboxylic acids (e.g., trimelitic acid and pyromelitic acid). In addition, it is suitable to use compounds prepared by reacting the acid anhydride or lower alkyl esters (e.g., methyl esters, ethyl esters and isopropyl esters) with polyol (1).

The polycarboxylic acids mentioned above can be used alone or in combination and are not limiting.

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

The peak molecular weight of the polyester resin is from 1,000 to 30,000, preferably from 1,500 to 10,000 and more preferably from 2,000 to 8,000. When the peak molecular weight it too small, high temperature preservability tends to deteriorate. When the peak molecular weight is too high, the low temperature fixing property easily deteriorates.

In addition, by using crystalline polyester, it is possible to obtain toner having an excellent low temperature fixing property and keep stable preservability of the toner.

The polyester resin in the subject matter of the present disclosure is preferably a crystalline polyester synthesized by an acid (dicarboxylic acid) composition and an alcohol (diol) composition. Hereinafter, in the polyester resin, the structure unit which was an acid composition before the synthesis of polyester resin is referred to as acid derived composition and the structure unit which was an alcohol composition before the synthesis of polyester resin is referred to as alcohol derived composition.

In the present disclosure, crystalline in crystalline polyester resin represents that there is a distinctive endothermic peak instead of step-like changes in endothermic amount in the differential scanning calorimeter (DSC). The endothermic peak may represents a peak having a width of 40 to 50° C. for toner. In the case a polymer in which other components are copolymerized in the main chain of the crystalline polyester mentioned above, when the other components are not greater than 50% by weight, the copolymer is referred to as crystalline polyester.

In addition, at least one of the components forming the polyester resins mentioned above is preferred to be a component having a sulfonic acid group. When at least one of the components forming the polyester resins mentioned above is a component having a sulfonic acid group, a charge double layer due to the sulfuric acid salt, resulting in good dispersion in an aqueous medium. Furthermore, when a coloring agent is added, the dispersion property of the coloring agent ameliorates. Also, it is possible to manufacture particulates by emulsifying or suspending the entire polyester resin in an aqueous medium without using a surface active agent described later. When used to manufacture a toner for use in electrophotography, the chance of producing coarse particles is small.

It is preferred to use a modified polyester resin having a urethane and/or urea group to adjust viscosity and elasticity for the core portion of the binder resin of the present disclosure. The content ratio of the modified polyester resin having a urethane and/or urea group is preferably not greater than 20%, more preferably not greater than 15% and further preferably not greater than 10% based on the binder resin. When the content ratio is too large, the low temperature fixing property may deteriorate. The modified polyester resin having a urethane and/or urea group can be directly mixed with a binder resin. However, in terms of manufacturing, it is preferred to mix a binder resin with a modified polyester resin (hereinafter referred to as prepolymer) having an isocyanate group at its end with a relatively low molecular weight and an amine reactive therewith and conduct chain elongation reaction and/or cross linking reaction during and/or after granulation to obtain the modified polyester resin having a urethane and/or urea group. Thereby, a modified polyester resin having a relatively high molecular weight for adjusting viscosity and elasticity can be easily contained in the core portion.

Prepolymer

Specific examples of the prepolymer having an isocyanate group include a compound obtained by reaction of a polyester and a polyisocyanate (3). The polyester is a polycondensation of the polyol (1) and the polycarboxylic acid (2) and has an active hydrogen group. Specific examples of the active hydrogen group include hydroxyl groups (alcohol hydroxyl groups and phenol hydroxyl groups), amino groups, carboxylic groups, and mercarpto groups. Among these, alcohol hydroxyl groups are preferred.

Polyisocyanate

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives thereof, oximes or caprolactams; etc. These compounds can be used alone or in combination. Ratio of isocyanulate group and hydroxyl group Suitable mixing ratio (i.e., [NCO]/[OH]) of a polyisocyanate (3) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. When the molar ratio of [NCO] is too small, the urea content of a modified polyester tends to be small and the offset resistance property easily deteriorates. The content of the constitutional component of a polyisocyanate (PIC) in the polyester prepolymer (A) having a polyisocyanate group at its end portion is from 0.5 to 40% by weight, preferably from 1 to 30% by weight and more preferably from 2 to 20% by weight. When the content is too low, the offset resistance of the toner deteriorates. In contrast, when the content is too high, the low temperature fixability of the toner deteriorates.

Number of Isocyanate Groups Included in Prepolymer

The number of isocyanate groups included in the prepolymer (A) per molecule is normally not less than 1, preferably from 1.5 to 3, and more preferably from 1.8 to 2.5. When the number of isocyanate groups is too small, the molecular weight of the modified polyester after chain-elongation reaction and/or cross-linking reaction tends to be small and the offset resistance property easily deteriorates.

Chain Elongation and/or Cross-Linking Agent

In the present disclosure, amines can be used as a Chain elongation and/or a cross-linking agent. Specific examples of the amines (B) include diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include the following:

aromatic diamines (e.g., phenylene diamine, diethyltoluene diamine, 4,4'-diaminodiphenyl methane, tetrafluoro-p-xylilene diamine and tetrafluoro-p-phenylene diamine);

alicyclic diamines (e.g., 4,4'-diamino-3,3'-dimethyldicyclohexyl methane, diaminocyclohexane and isophorone diamine); and aliphatic diamines (e.g., ethylene diamine, tetramethylene diamine, hexamethylene diamine, dodecafluorohexylene dimaine and tetra)

Specific examples of the polyamines (B2) having three or more amino groups include diethylene triamine, and triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone, for example, acetone, methyl ethyl ketone and methyl isobutyl ketone and oxazoline compounds.

Molecular-Weight Control Agent

The molecular weight of the modified polyesters obtained after chain elongation reaction and/or cross-linking agent can be controlled using a molecular-weight control agent, if desired. Specific preferred examples of the molecular-weight control agent include monoamines (e.g., diethyl amine, dibutyl amine, butyl amine and lauryl amine), and blocked amines (i.e., ketimine compounds) prepared by blocking the monoamines mentioned above.

Ratio of the Amine Group and Isocyanate Group

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea-modified polyester (i) is small, resulting in deterioration of the hot offset resistance of the resultant toner.

Vinyl-Based Copolymer Resin

There is no specific limit to the vinyl-based copolymer resin for use in the subject matter of the present disclosure and any vinyl-based copolymer resin can be used. These copolymer resins can be used in combination. The weight average molecular weight of the copolymer resins is preferably from 3,000 to 50,000, more preferably from 5,000 to 30,000 and further preferably from 7,000 to 20,000. When the molecular weight is too small, a problem occurs such that resins may fixated to, for example, a developing device. When the molecular weight is too large, the low temperature fixing property tends to deteriorate. In addition, the glass transition temperature of these copolymer resins is preferably from 40 to 80° C. and more preferably from 50 to 70° C. When the glass transition temperature is too high, the low temperature fixing property tends to deteriorate and when the glass transition temperature is too low, the high temperature preservability tends to deteriorate.

The vinyl based copolymer resins are polymers obtained by copolymerizing a vinyl-based monomer. Specific examples of vinyl-based monomer include the following (1) to (10).

(1) Vinyl-Based Hydrocarbon

Aliphatic vinyl-based hydrocarbons: alkenes, for example, ethylene, propylene, isobutylene, pentene, heptene, diisobutylene, octene, dodecene, octadecene and α-olefins other than the mentioned above; and alkadienes, for example, butadiene, isoprene, 1,4-pentadiene, 1,6-hexadiene, and 1,7-octadiene.

Alicyclic vinyl-based hydrocarbons: mono- or di-cycloalkenes, for example, cyclohexene, (di)cyclopentadiene, vinylcyclohexene and ethylidene bicycloheptene; terpenes, for example, pinene, limonene and indene.

Aromatic vinyl-based hydrocarbons: styrene and hydrocarbyls (alkyl, cycloalkyl, aralkyl and/or alkenyl) substitution products thereof, for example, α-methylstyrene, vinyltoluene, 2,4-dimethyl styrene, ethylstyrene, isopropyl styrene, butyl styrene, phenyl styrene, cyclohexyl styrene, benzyl styrene, crotyl benzene, divinyl benzene, divinyl toluene, divinyl xylene and trivinyl benzene; and vinylnaphthalene.

(2) Vinyl-Based Monomer Containing Carboxyl Group and Salts Thereof

Unsaturated monocarboxylic acids having 3 to 30 carbon atoms, unsaturated dicarboxylic acid, anhydrides thereof and monoalkyl esters thereof, for example, (meth)acrylic acid, maleic acid (anhydride), monoalkyl esters of maleic acid, fumaril acid, monoalkyl esters of fumaric acid, crotonic acid, itaconic acid, monoalkyl esters of itaconic acid, glycol monoethers of itaconic acid, citraconic acid, and monoalkyl esters of citraconic acid, and carboxyl group containing vinyl based monomer, for example, cinnamic acid.

(3) Vinyl-based monomers containing sulfonic acid group, vinyl based monoesters of sulfuric acid and slat thereof: Alkene sulfonates having 2 to 14 carbon atoms, for example, (meth)allylsulfonate, methylvinyl sulfonate, and styrene sulfonate; alkyl derivatives thereof having 2 to 24 carbon atoms; for example, α-methylstyrene sulfonate; sulfo(hydroxyl) alkyl-(meth)acrylate or (meth)acryl amides, for example, sulfo propyl(meth)acrylate, 2-hydroxy-3-(meth)acryloxy propylsulfonate, 2-(meth)acryloyl amino-2,2-dimethylethane sulfonate, 2-(meth)acryloyloxy ethane sulfonate, 3-(meth)acryloyoxy-2-hydroxypropane sulfonate, 2-(meth) acrylamide-2-methylpropane sulfonate, 3-(meth)acrylamide-2-hydroxypropane sulfonate, alkyl (3 to 18 carbon atoms) allyl sulfosuccinate, sulfonic esters of poly(n=2 to 30) oxyalkylene (ethylene, propylene, butylenes: single, random, or blocked) mono(meth)acrylate (e.g., sulfonic esters of poly (n=5 to 15)oxypropylene monomethacrylate, and sulfonic esters of polyoxyethylene polycyclic phenyl ether);

(4) Vinyl based monomer containing phosphoric group and salts thereof (meth)acryloyloxyalkyl phosphoric acid monoesters, for example, 2-hydroxyethyl(meth)acryloyl phosphate, phenyl-2-acryloyloxy ethyl phosphonate, and their salts.

Specific examples of the salts (2) to (4) mentioned above) include, alkali metal salts (sodium salts, potassium salts, etc.), alkali earth metal salts (calcium salts, magnesium salts, etc.), ammonium salts, amine salts, or quaternary ammonium salts.

(5) Vinyl-Based Monomer Containing Hydroxyl Group

Hydroxystyrene, N-methylol(meth)acryl amide, hydroxyethyl (meth)acrylate, hydroxypropyl(meth)acrylate, polyethylene glycol mono(meth)acrylate, (meth)allylalcohol, crotylalcohol, isocrotylalcohol, 1-butane-3-ol, 2-butane-1-ol, 2-butane-1,4-diol, propargylalcohol, 2-hydroxyethylpropenylether and sucrose allylethers.

(6) Vinyl-Based Monomer Containing Nitrogen

Vinyl-based monomers containing an amino group: aminoethyl(meth)acrylate, dimethylaminoethyl(meth)acrylate, diethylaminoethyl(meth)acrylate, t-butylaminoethyl methacrylate, N-aminoethyl(meth)acrylamide, (meth)allylamine, morpholinoethyl(meth)acrylate, 4-vinylpyridine, 2-vinylpyridine, crotylamine, N,N-dimethylaminostyrene, methyl-α-acetoaminoacrylate, vinylimidazole, N-vinylpyrrol, N-vinylthiopyrolidone, N-arylphenylene diamine, aminocarbazole, aminothiazole, aminoindol, aminopyrrol, aminoimidazole, aminomercapto thiazole, their salts, etc.;

Vinyl-based monomers containing an amide group: (meth) acrylamide, N-methyl(meth)acrylamide, N-butyl acrylamide, diacetone acrylamide, N-methylol(meth)acrylamide, NmN-methylene-bis(meth)acrylamide, cinnamic amide, NmN-dimethylacrylamide, N,N-dibenzylacrylamide, methacryl formamide, N-methyl-N-vinylacetamide, N-vinylppyrolidone, etc.;

Vinyl-based monomers containing a nitrile group: (meth) acrylonitrile, cyanostyrene, cyanoacrylate, etc.;

Vinyl-based monomers containing a quaternary ammonium cation group: quaternarized (by quaternarizing agent, for example, methyl chloride, dimethyl sulfonate, benzylchloride, dimethyl carbonate, etc.) compound of vinyl-based monomers containing tertiary amine group, for example, dimethylaminoethyl(meth)acrylate, diethylaminoethyl (meth)acrylate, dimethylaminoethyl(meth)acrylamide, diethylaminoethyl(meth)acrylamide and diallylamine; and Vinyl-based monomer containing a nitro group: nitrostyrene, etc.

(7) Vinyl-Based Monomer Containing an Epoxy Group glycidyl(meth)acrylate, tetrahydrofurfuryl(meth)acrylate, p-vinylphenylphenyloxide, etc.

(8) Vinylester, Vinyl(Thio)Ether, Vinylketone, Vinyl Sulfonate

Vinylesters, for example, vinyl acetate, vinylbutylate, vinyl propionate, diallylphthalate, diallyladipate, isopropenyl acetate, vinyl methacrylate, methyl-4-vinylbenzoate, cyclohexylmethacrylate, benzylmethacrylate, phenyl(meth) acrylate, vinylmethoxyacetate, vinylbenzoate, ethyl-α-ethoxyacrylate, alkyl(meth)acrylate having 1 to 50 carbon atoms (e.g., methyl(meth)acrylate, ethyl(meth)acrylate, propyl(meth)acrylate, butyl(meth)acrylate, 2-ethylhexyl(meth) acrylate, dodecyl(meth)acrylate, hexadecyl(meth)acrylate, heptadecyl(meth)acrylate, eicocyl(meth)acrylate, etc.), dialkylfumarate (straight, chained, branch-chained or cyclic alkyl groups having 2 to 8 carbon atoms), dialkylmaleate (straight, chained, branch-chained or cyclic alkyl groups having 2 to 8 carbon atoms), poly(meth)alyloxy alkanes (e.g., dialyloxy ethane, trialyloxy, ethane, tetraalyloxy ethane, tetraalyloxy propane, tetraalyloxy butane, tetramethalyloxy ethane, etc.);

vinyl-based monomers having polyalkylene glycol chain (e.g., polyethyleneglycol (molecular weight: 300) mono (meth)acrylate, polypropylene glycol (molecular weight: 500)monoacrylate, adducts of (meth)acrylate with 10 mol methylalcoholethyleneoxide, adducts of (meth)acrylate with 30 mol lauryl alcohol ethylene oxide, etc. Poly(meth)acrylates (e.g., poly(meth)acrylate of polyalcohols, for example, ethylene glycol di(meth)acrylate, propylene glycol di(meth) acrylate, neopentyl glycol di(meth)acrylate, trimethylol propane tri(meth)acrylate and polyethylene glycol di(meth)acrylate); vinyl(thio)ethers, for example, vinylmethylether, vinylethyl ether, vinylpropyl ether, vinylbutylether, vinyl-2-ethylhexyl ether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercapto ethylether, acetoxystyrene, phenoxystyrene, etc.;

vinylketones, for example, vinylmethylketone, vinylethylketone, vinylphenylketone, etc.; and vinylsulfones, for example, divinylsulfide, p-vinyldiphenyl sulfide, vinylethylsulfide, vinylethylsulfone, divinylsulfone, divinylsulfoxide, etc.

(9) Other Vinyl Monomers

Isocyanato ethyl(meth)acrylate, m-isopropenyl-α,α'-dimethylbenzylisocyanate, etc.

(10) Vinyl-Based Monomers Containing Fluorine Atom 4-fluorostyrene, 2,3,5,6-tetrafluorostyrene, pentafluorophenyl(meth)acrylate, pentafluorobenzyl(meth)acrylate, pentafluorocyclohexyl(meth)acrylate, pentafluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl (meth)acrylate, 1H,1H,7H-dodecafluoroheptyl(meth) acrylate, perfluorooctyl(meth)acrylate, 2-perfluorooctylethyl(meth)acrylate, heptadecafluorodecyl (meth)acrylate, trihydroperfluorooctylethyl(meth)acrylate, heptadecafluorodecyl(meth)acrylate, trihydroperfluoroundecyl(meth)acrylate, perfluoronorbonylmethyl(meth)acrylate, 1H-perfluoroisobonyl(meth)acrylate, 2-(N-butylperfluorooctane sulfoneamide) ethyl(meth)acrylate, 2-(N-ethylperfluorooctane sulfone amide)ethyl(meth)acrylate, and compounds derived from α-fluoroacrylate;

bis-hexafluoroisopropyl itaconate, bis-hexafluoroisopropyl maleate, bis-perfluorooctyl itaconate, bis-perfluorooctyl maleate, etc.; and vinyl heptafluorobutylate, vinylperfluoroheptanoate, vinylperfluorononanoate, vinylperfluorooctanoate, etc.

Vinyl-Based Copolymer

Specific examples of copolymers of the vinyl-based monomers include polymers copolymerized from at least two monomers selected from the monomers mentioned in (1) to (10) in any combination with any ratio. For example, styrene-(meth)acrylate copolymers, styrene-butadiene copolymers, copolymers of esters of (meth)acrylic acid-acrylic acid, styrene-acrylonitrile copolymers, copolymers of styrene-anhydride of maleic acid, styrene-(meth)acrylic acid copolymers, styrene-(meth)acrylic acid and divinyl benzene copolymers, and copolymers of esters of styrene-styrene sulfonate-(meth) acrylic acid can be used.

Vinyl-Based Copolymer Resin Particulate

Vinyl-based resin particulates can be manufactured by a method in which the vinyl-based copolymer resin is dispersed in an aqueous medium and can also be easily manufactured by a typical method, for example, an emulsion polymerization method.

Furthermore, the emulsion in the present disclosure preferably has the ratio of the composition mentioned above having a sulfonic acid group of from 0.25 to 15 mol %, preferably from 0.25 to 5 mol %, and particularly preferably from 0.25 to 2 mol %, based on all the components forming the crystalline polyester resin mentioned above. When the rate of the composition mentioned above having a sulfuric acid is excessive, the hydrophilic property of the polyester resin increases, which may lead to deterioration of the charging property of toner in a high humidity environment. To the contrary, When the rate of the composition mentioned above having a sulfuric acid is too small, the charge double layer is not sufficiently stabilized, resulting in production of coarse particles.

The composition mentioned above having a sulfuric acid is preferably the dicarboxylic acid described later having a sulfuric acid. The diol described later having a sulfuric acid or a combination thereof are suitable. In any case, it is preferred that the ratio of the sum of the compositions mentioned above having a sulfuric acid based to the sum of all the compositions forming the crystalline polyester resin mentioned above satisfies the regulation on the rate mentioned above of the composition having a sulfuric acid.

Various kinds of acids can be suitable as the acid mentioned above for the acid derived composition. Preferred specific examples of the acid derived composition in a polyester resin include an aliphatic dicarboxylic acid and a straight chain type carboxylic acid is particularly preferred.

Specific examples of the aliphatic dicarboxylic acid include oxalic acid, malonic acid, succinic acid, glutaric acid, adipic acid, pimelic acid, suberic acid, azelinic acid, sebacic acid, 1,9-nonan dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid and their lower alkyl esters and acid anhydride but not limited thereto. Among these, in terms of availability, sebacic acid and 1,10-decanedicarboxylic acid are preferred.

Specific examples of the aromatic dicarboxylic acid include terephthalic acid, isophthalic acid, orthophthalic acid, t-butyl isophthalic acid, 2,6-naphthalene dicarboxylic acid, and 4,4-biphenyl dicarboxylic acid. Among these, terephthalic acid, isophthalic acid, and t-butyl isophthalic acid are preferred in terms of availability and formation of easily emulsified polymers.

As the acid derived compositions mentioned above, in addition to the aliphatic dicarboxylic acid derived compositions and aromatic dicarboxylic acid derived compositions, dicarboxylic acid derived composition having a double bond and dicarboxylic acid derived composition having a sulfonic acid group can be included.

Specific examples of the dicarboxylic acid derived composition having a double bond include compositions derived from lower alkyl esters or acid anhydrides of a dicarboxylic acid having a double bond in addition to dicarboxylic acid derived composition having a double bond. Specific examples of the dicarboxylic acid derived composition having a sulfonic acid group include compositions derived from lower alkyl esters or acid anhydrides of a dicarboxylic acid having a sulfonic acid group in addition to the dicarboxylic acid derived composition having a sulfonic acid group.

The dicarboxylic acid mentioned above having a sulfonic acid group can be suitably used in terms of that the entire resin can be cross-linked using the double bond to prevent hot offset during fixing. Specific examples of such dicarboxylic acids having a sulfonic acid group include fumaril acid, maleic acid, 3-hexene dioic acid, 3-octene dioic acid and, lower alkyl esters and acid anhydrides thereof but are not limited thereto. Among these, fumaril acid and maleic acid are preferred in light of cost.

The content ratio of the dicarboxylic acid derived composition having a double bond to the all acid derived composition is preferably not greater than 20 composition mol % and more preferably from 2 to 10 composition mol %.

When the content ratio is too large, crystalline property of a polyester resin tends to deteriorate and the melting point easily lowers, resulting in deterioration of preservability of images.

Specific examples of the dicarboxylic acid having a sulfonic acid group include 2-sulfoterephthalic acid sodium salt, 5-sulfoisophthalic acid sodium salt, sulfosuccinic acid sodium salt and lower alkylesters and acid anhydrides thereof but are not limited thereto. Among these, 5-sulfoisophthalic acid sodium is preferred in light of cost.

When the composition mentioned above having a sulfonic acid group which is preferred as described above is only dicarboxylic acids having a sulfonic acid group, the polyester is a polycondensation formed of the carboxylic acid and an alcohol having significantly the same mol %. The content ratio of the dicarboxylic acids having a sulfonic acid group to the all acid derived composition is preferably from 0.5 to 30 composition mol %, more preferably from 0.5 to 10 composition mol % and further preferably from 0.5 to 4 composition mol %.

In the specification, composition mol % represents percentage when each composition (acid derived composition or alcohol derived composition) in a polyester resin is set to be one unit (mol).

Alcohol Derived Composition

As the alcohol for the alcohol derived composition, aliphatic diols are preferred and straight-chain type aliphatic diols having 7 to 20 carbon atoms in the chain are more preferred. When the aliphatic diol is a branch type, the crystalline property of the polyester resin deteriorates and the melting point thereof lowers. Because of this, when this type is used in the method of manufacturing toner described later and the thus obtained toner is used to form images, anti-toner blocking property, image preservability and low temperature fixability may deteriorate. When an aliphatic diol having too few carbon atoms is polycondensed with an aromatic dicarboxylic acid, the melting point of the resultant may be high, which leads to difficulty of low temperature fixing. To the contrary, when the number of carbon atoms is too large, it may cause difficulty in obtaining practical materials therefor. The number of carbon atoms in the chain is preferably not greater than 14.

In addition, when a polyester is obtained by polycondensation with an aromatic dicarboxylic acid, the number of carbon atoms in the chain is preferably an odd number. When the number of carbon atoms in the chain is an odd number, the melting point of the resultant polyester resin is relatively low in comparison with the case in which the number of carbon atoms in the chain is an even number and tends to be within the range mentioned later.

Specific examples of aliphatic diols include ethylene glycol, 1,3-propanediol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosan diol but are not limited thereto. Considering the availability, 1,8-octane diol, 1,9-nonane diol and 1,10-decane diol are preferred. In light of the melting point, 1,9-nonane diol is preferred.

With regard to the alcohol derived composition, the content ratio of aliphatic diol derived composition is not less than 80 composition mol % and preferably not less than 90 composition mol % and other compositions can be optionally contained.

When the content ratio of aliphatic diol derived composition is too small, the crystalline property of a polyester resin tends to deteriorate and the melting point easily lowers so that anti-toner blocking property, image preservability and low temperature fixability may deteriorate. Specific examples of the other optional compositions include diol derived compositions having a double bond and diol derived compositions having a sulfonic acid group Specific examples of the diols mentioned above having a double bond include 2-butane-1,4-diol, 3-butane-1,6-diol and 4-butane-1,8-diol. The content ratio of these diols having a double bond to the all acid derived composition is preferably not greater than 20 composition mol % and more preferably from 2 to 10 composition mol %.

When the composition ratio is too large, the crystalline property of a polyester resin tends to deteriorate and the melting point easily lowers, resulting in deterioration of image preservabiltiy.

Specific examples of the diol mentioned above having a sulfonic acid group include 1,4-dihydroxy-2-sulfuric acid benzene sodium salt, 1,3-dihydroxymethyl-5-sulfuric acid benzene sodium salt and 2-sulfo-1,4-butanediol sodium salt. When the composition having a sulfonic acid group is only a diol having a sulfonic acid group, the resultant polyester is a polycondensation formed of the carboxylic acid and an alcohol having significantly the same mol %. The content ratio of the diol having a sulfonic acid group to the all acid derived composition is preferably from 0.5 to 30 composition mol %, more preferably from 0.5 to 10 composition mol % and further preferably from 0.5 to 4 composition mol %.

When another alcohol derived composition (diol derived composition having a double bond and diol derived composition having a sulfonic acid group) other than the aliphatic diol derived composition is added, the content ratio of these to alcohol derived composition is preferably not greater than 20 composition mol % and more preferably from 2 to 10 composition mol %.

The melting point of the polyester resin is preferably from 60 to 120° C. and more preferably from 70 to 100° C. When the melting point is too low, agglomeration of powder tends to occur and perservability of a fixed image may deteriorate. To the contrary, when the melting point is too high, a toner image may not be able to be fixed at a low temperature.

In the present disclosure, the melting point of the polyester resin mentioned above is measured using a differential scanning calorimeter (DSC) and the value of the top of the endotherm peak is used when the measure is performed at a temperature rising speed of 10° C. per minute from room temperature to 150° C.

There is no specific limit to the method of manufacturing the polyester resin mentioned above. The polyester is manufactured by a typical polyester polymerization method in which an acid composition and an alcohol composition are reacted. For example, direct polycondensation, ester exchange method, etc. can be selected depending on the kind of monomers. The mol ratio (acid composition/alcohol composition) when the acid composition and the alcohol composition mentioned above are reacted depends on the reaction conditions and typically is 1/1.

The polyester mentioned above can be manufactured in the polymerization temperature from 180 to 230° C. and the reaction system is reduced in pressure, if desired, to remove water and alcohol produced during condensation.

When a monomer is not dissolved or compatible at a temperature lower than the reaction temperature, a solvent having a high melting point is added as a dissolution helping agent to promote dissolution. The polycondensation reaction is conducted while removing such a dissolution helping agent. When a monomer having a bad compatibility is present in copolymerization reaction, it is good to condense the monomer having a bad compatibility with the acid or the alcohol planned to be polycondensed therewith before polycondensation with the main component.

Specific examples of catalysts usable when the polyester resin mentioned above is manufactured include compounds of alkali metals, for example, sodium and lithium, compounds of alkaline earths metals, for example, zinc, manganese, antimony, titanium, tin, zirconium and germanium, phosphorous acid compounds, phosphoric acid compounds and amine compounds. These specific examples are:

Sodium acetate, sodium carbonate, lithium acetate, lithium carbonate, calcium acetate, calcium stearate, magnesium acetate, zinc acetate, zinc stearate, sodium naphthenate, zinc chloride, manganese acetate, manganese naphthenate, titanium tetraethoxido, titanium tetrapropoxide, titanium tetraisopropoxide, titanium tetrabutoxide, antimony trioxide, tiphenyl antimony, tributyl antimony, zinc formate, zinc oxalate, tetraphenyl tin, dibutyl tin dichloride, dibutyltin oxide, diphenyl tinoxide, zirconium tetrabutoxide, zirconium naphthenate, zirconyl carbonate, zirconyl acetate, zirconyl stearate, zirconyl octylate, germanium oxide, triphenyl phosphate, tris(2,4-di-t-butylphenyl)phosphate, ethyltriphenyl phosphonium bromide, triethylamine and triphenyl amine.

Coloring Agents

Any known dyes and pigments can be used as the coloring agent in the subject matter of the present disclosure. Specific examples thereof include carbon black, nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the colorant in the toner is preferably from 1 to 15% by weight, and more preferably from 3 to 10% by weight, based on the total weight of the toner.

The toner of the present disclosure contains wax component.

Specific examples thereof include polyolefin waxes (e.g., polyethylene waxes and polypropylene waxes); hydrocarbons having a long chain (e.g., paraffin waxes and SASOL waxes); and waxes having a carbonyl group. Specific preferred examples of the waxes including a carbonyl group include polyalkanoic acid esters (e.g., carnauba waxes, montan waxes, trimethylolpropane tribehenate, pentaerythritol tetrabehenate, pentaerythritol diacetate dibehenate, glycerin tribehenate, and 1,18-octadecanediol distearate); polyalkanol esters (e.g., tristearyl trimellitate, and distearyl maleate); polyalkanoic acid amides (e.g., ethylenediamine dibehenylamide); polyalkylamides (e.g., trimellitic acid tristearylamide); and dialkyl ketone (e.g., distearyl ketones). Among these materials, polyalkanoic acid esters are more preferred.

In the present disclosure, waxes having a low polarity are preferably used. Specific examples thereof include hydrocarbon based waxes, for example, polyethylene wax, polypropylene wax, paraffin wax, sazol was, microcrystalline wax and Fischer-Tropsch wax.

The content of wax in the toner is from 3 to 15% by weight, preferably from 4 to 12% by weight and more preferably from 5 to 10% by weight based on 100% by weight of the resin composition. When the content of wax based on the entire toner is too small, the wax does not have a sufficient releasing effect and adequately prevent offset. To the contrary, in the case of the content being too large, since wax is melted at a low temperature, the wax is easily affected by thermal energy and mechanical energy. Therefore, wax may ooze from the inside toner during stirring in a developing portion, etc., and attach to a toner layer regulating member or an image bearing member, resulting in the occurrence of image noise. In addition, when printed in a transparent sheet, such wax extends to the outside the printing area and may appear as image noise when an image is projected.

The range of endothermic peak measured by a differential scanning calorimeter (DSC) while the temperature is raised is preferably from 60 to 90° C. and more preferably from 65 to 80° C. When the endothermic peak is too low, the fluidity and high temperature preservability may deteriorate. When the endothermic peak is too high, the fixing property tends to worsen.

The half value width of the endothermic peak measured by a differential scanning calorimeter (DSC) while the temperature is raised is preferably not higher than 8° C., and more preferably not higher than 6° C. When the half width of endothermic peak is too broad, the fluidity and high temperature preservability may deteriorate.

Charge Controlling Agent

Charge controlling agent may be suitably selected for use in the toner of the present disclosure. Any known charge controlling agent can be used. Specific examples thereof include nigrosine dyes, triphenylmethane dyes, chrome containing metal complex dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc. Specific examples thereof include BONTRON 03 (nigrosine dye), BONTRON P-51 (quaternary ammonium salt), BONTRON S-34 (metal containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group, for example, sulfonic acid group, carboxyl group, quaternary ammonium group, etc.

External Additives

Specific examples of external additives that improves developability and chargeability of the toner particle obtained in the subject matter of the present disclosure include known inorganic particulates and polymer particulates.

Inorganic Particulates

The primary particle diameter of the inorganic particulate is preferably from 5 nm to 2 μm and particularly preferably from 5 to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Polymer Particulate

Polymer particulates, for example, polymers and copolymers of styrene, methacrylates, acrylates; polymers, for example, silicone resins, benzoguanamine resins and nylon resins prepared by polycondensation polymerization; and thermosetting resins, which can be prepared by a soap-free emulsion polymerization method, a suspension polymerization method or a dispersion polymerization method, can also be used as the external additive.

Surface Treatment of External Additive

These materials for use as the external additive (fluidizer) can be subjected to a surface treatment to be hydrophobized, thereby preventing the fluidity and charge properties of the toner even under high humidity environment. Specific examples of such surface treatment agents include silane coupling agents, silylation agents, silane coupling agents including a fluoroalkyl group, organic titanate coupling agents, aluminum coupling agents, silicone oils, modified silicone oils, etc.

Cleanability Improving Agent

The toner of the present disclosure may include a cleanability improving agent to improve the cleaning ability thereof such that the toner remaining on an image bearing member (e.g., photoreceptor) and an intermediate transfer belt can be easily removed therefrom. Specific examples of the cleanability improving agents include aliphatic acid and metal salts thereof, for example, zinc stearate, calcium stearate and stearic acid; polymer particulates which are prepared by a soap-free emulsion polymerization method or the like, for example, polymethyl methacrylate particles and polystyrene particles. It is preferred that the polymer particulates have a narrow particle diameter distribution and the weight average particle diameter thereof is from 0.01 to 1 μm.

A method of manufacturing the toner of the present disclosure includes the process of forming a first resin particulate by dispersing wax in a solution in which a resin having at least a polyester skeleton is dissolved in an organic solvent followed by suspension in an aqueous medium, and the process of agglomerating and/or fusion bonding at least two resin particulates including the first resin particulate dispersed in the aqueous medium.

Wax other than the wax contained in the first resin particulate can be used. Such wax can be contained in the other resin particulates or can be agglomerated by using the primary particles thereof.

Below is the detailed description of the method. Manufacturing of Organic Resin Particulate Containing Wax by Dissolution, Suspension and Dispersion of Polyester-based Resin Organic Solvent As the organic solvent for granulation, it is preferred to use a volatile organic solvent having a boiling point of not higher than 100° C. in light of removal of the organic solvent performed later. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, methyl acetate and ethyl acetate, methylethyl ketone and methylisobuthyl ketone. These can be used alone or in combination. Especially, ester based compounds, for example, methyl acetate and ethyl acetate, aromatic hydrocarbons, for example, toluene and xylene, and halogenated hydrocarbons, for example, methylene chloride, 1,2-dichloroethane, chloroform and carbon tetrachloride, are preferred. Polyester resin, wax and an optional coloring agent can be simultaneously dissolved or dispersed. Typically, these components are separately dissolved or dispersed in the same or different organic solvent. Taking into account the removal of the organic solvent later, the organic solvent is preferred to be the same. When a solvent (single or mixture) which can suitably dissolve the polyester resin is selected, wax which can be preferably used in the subject matter of the present disclosure is not dissolved in the solvent because of the difference in solubility. Namely, wax (and coloring agent) is dispersed in a solvent in which polyester based resin is dissolved, which is preferred.

Dissolution or Dispersion of Polyester-Based Resin

The solution or liquid dispersion of a polyester resin preferably has a resin density of from about 40 to about 80%. When the density is too high, dissolution or dispersion is difficult and it is inconvenient to deal with a solution having a high viscosity. In addition, when the density is too low, the amount of manufacturing particulates may decrease and the amount of solvent to be removed increases. When a modified polyester resin having an isocyanate group at its end is mixed with a polyester based resin, both can be dissolved or dispersed in the same or different solution. Considering the solubility and viscosity of each, it is preferred to manufacture solution or liquid dispersion separately.

Dispersion of Wax

When wax functioning as a releasing agent is dispersed, liquid dispersion is prepared by a typical method. That is, an organic solvent and wax are mixed followed by dispersion by a dispersing device, for example, a bead mill. In addition, it is possible to mix an organic solvent and wax, then heat the mixture to the melting point of the wax and cool down while stirring followed by dispersion by a dispersing device, for example, a bead mill. The dispersion time can be shortened by this method. Multiple kinds of waxes can be mixed in combination and a dispersion helping agent or a polyester resin can be added thereto.

The dispersion particle diameter is adjusted to control the size of a domain wax forms when wax is contained in a resin particulate. When the domain is too large, the wax may be isolated. The same is true in the case of a wide distribution. Preferred size of a resin particulate is from 0.1 to 1 μm. However, When the dispersion particle diameter is too small, wax tends to agglomerate and therefore, a domain having a relatively large size is formed in most cases when the domain is contained in a resin particulate. By controlling the dispersion particle diameter in liquid dispersion and the particle diameter of a resin particulate, it is possible to obtain a domain having a desired size in a resin particulate.

Aqueous Medium

Suitable aqueous media for use in the subject matter of the present disclosure include water, and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc. The content of the aqueous medium is from 50 to 2,000 parts by weight and preferably from 100 to 1,000 parts by weight based on 100 parts by weight of resin particulate.

Inorganic Dispersing Agent and Organic Resin Particulate

When the dissolved material or dispersed material mentioned above of the polyester resin and wax is dispersed in the aqueous medium mentioned above, it is preferred to disperse an inorganic dispersing agent or an organic resin particulate in the aqueous medium beforehand for making the particle size distribution sharp and stabilizing dispersion. Specific examples of such inorganic dispersing agents include tricalcium phosphate, calcium carbonate, titanium oxide, colloidal silica and hydroxyapatite. Specific examples of resins forming such organic resin particulates include any resin that can form an aqueous dispersion body. Either of theremoplastic resins or thermocuring resins can be used. For example, vinyl-based resins, polyurethane resins, epoxy resins, polyester resins, polyamide resins, polyimide resins, silicon based resins, phenol resins, melamine resins, urea resins, aniline resins, ionomer resins and polycarbonate resins can be used. These resins can be used alone or in combination. Among these, considering that an aqueous dispersion body of fine spherical resin particles can be easily obtained, vinyl-based resins, polyurethane resins, epoxy resins, polyester resins and their combinational use thereof are preferred.

Surface Active Agent

In addition, it is possible to use a surface active agent, if desired, when manufacturing the resin particulate mentioned above. Specific examples of the surface active agents include anionic dispersing agents, for example, alkylbenzene sulfonic acid salts, α-olefin sulfonic acid salts, and phosphoric acid salts; cationic dispersing agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersing agents, for example, fatty acid amide derivatives, polyhydric alcohol derivatives; and ampholytic dispersing agents, for example, alanine, dodecyldi(aminoethyl)glycin, di)octylaminoethyle) glycin, and N-alkyl-N,N-dimethylammonium betaine.

In addition, a good dispersion can be prepared with an extremely small amount of a surface active agent having a fluoroalkyl group. Specific examples of the anionic surface active agents having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc. Specific examples of the cationic surface active agents having a fluoroalkyl group include primary, secondary and tertiary aliphatic amino acids, aliphatic quaternary ammonium salts (for example, perfluoroalkyl (C6-C10)sulfoneamidepropyltrimethyl ammonium salts), benzalkonium salts, benzetonium chloride, pyridinium salts, and imidazolinium salts.

Protection Colloid

Furthermore, it is possible to stably disperse toner components in an aqueous medium using a polymeric protection colloid. Specific examples of such protection colloids include polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protective colloid. When compounds, for example, calcium phosphate, which are soluble in an acid or alkali, are used as a dispersion stabilizer, it is possible to dissolve the compounds by adding an acid, for example, hydrochloric acid, followed by washing of the resultant particles with water, to remove the compounds from toner mother particles. In addition, a zymolytic method can be used to remove such compounds. When a dispersing agent is used, it is possible to allow the dispersing agent remain on the surface of toner particles but it is desired to remove the agent by washing in light of the charging property of toner.

Dispersion Method

There is no particular restriction for the dispersion method. Low speed shearing methods, high speed shearing methods, friction methods, high pressure jet methods, ultrasonic methods, etc., can preferably be used. When a high speed shearing type dispersion machine is used, there is no particular limit to the rotation speed thereof, but the rotation speed is typically from 1,000 to 30,000 rpm, and preferably from 5,000 to 20,000 rpm. The temperature in the dispersion process is typically from 0 to 150° C. (under pressure), and preferably from 20 to 80° C.

Removal of Solvent

To remove an organic solvent from an obtained emulsion dispersion body, known methods can be used. For example, a method can be adopted in which the entire system is gradually heated under a reduced pressure or normal pressure to evaporate and completely remove an organic solvent in droplets.

Elongation and/or Cross-Linking Reaction

When a modified polyester resin having an isocyanate group at its end and an amine reactive therewith are added to introduce a modified polyester resin having a urethane group and/or a urea group, it is possible to mix an amine in an aqueous medium or in an oil phase before dispersing a toner composition in an aqueous medium. The time to be taken for reaction is determined depending on the reaction property of the isocyanate structure contained in an polyester prepolymer and an added amine and is from 1 minute to 40 hours and preferably from 1 to 24 hours. The reaction temperature is from 0 to 15° C. and preferably from 20 to 98° C. This reaction can be conducted in a fusion bond process performed after this resin particulate and other resin particulates are attached or agglomerated.

Granulation of Core Particle by Agglomeration of Resin Particulate

As described above, the first resin particulate for use in the subject matter of the present disclosure can be granulated by dispersion with wax in an aqueous medium after dissolution in an organic solvent. In addition, when a vinyl-based copolymer resin is used, it is possible to easily obtain liquid dispersion of resin particulate using an emulsion polymerization, etc.

Coloring Agent

When a coloring agent is simultaneously agglomerated during this granulation, it is preferred to directly disperse powder of the coloring agent in an aqueous medium. A dispersing agent, for example, a surface active agent, can be used together at this time. To uniformly dispersed a coloring agent, a bead mill is preferably used.

Agglomeration Process

Toner is granulated by mixing the multiple liquid dispersions of resin particulates and liquid dispersion of coloring agent followed by agglomeration thereof. Particularly, the coloring agent is preferably dispersed in the obtained toner. To control the agglomeration status, methods of heating, adding metal salt, or adjusting pH, are preferably used. The liquid dispersions of resin particulates can be added at one time or separately. The same applies to the liquid dispersion of coloring agent. There is no specific limit to the metal salt mentioned above. Specific examples of a monovalent metal forming a salt include sodium and potassium. Specific examples of divalent metal include calcium and magnesium. Specific examples of trivalent metal include aluminum. Anions forming such a salt are, for example, chloride ion, bromide ion, iodide ion, carboxylic ion and sulfuric acid ion. Among these, magnesium chloride, aluminum chloride and their complexes or multimeric compounds are preferred. In addition, fusion bonding between resin particulates can be promoted by heating in the middle of or after agglomeration. This is preferred in terms of uniformity of toner. Furthermore, it is possible to control the form of toner. Generally, as the heat increases, toner tends to be close to a sphere. In addition, it is possible to add more resin particulates in this process to agglomerate on the surface of a nuclear particle, which makes a structure referred to as core-shell structure.

Washing and Drying Process

Known technologies are used to wash and dry toner particles dispersed in an aqueous medium.

After solid portions and liquid portions are separated by a centrifugal, filter press, etc., the obtained toner cake is redispersed in deionized water at a temperature range of from about 0 to about 40° C. Subsequent to optional pH adjustment of acid and alkali, the solid portion and the liquid portion are separated again. These processes are repeated several times to remove impurities and a surface active agent. Subsequently, the resultant is dried by, an air drier, a circulation drier, a reduced pressure drier, a vibration fluidization drier, etc. to obtain toner powder. It is possible to remove toner particulates by centrifugation or a known air classifier to obtain a desired particle distribution, if desired, after drying.

External Additive Treatment

It is possible to mix dried toner powder with other particles, for example, charge controlling agents and fluidizer particulates, and impart mechanical impact on the mixture powder to fix and merge the other particles. Therefore, the other particles are prevented from detaching from the obtained complex particles. For example, the following methods are used: a method of imparting an impact on a mixture by wings rotating at a high speed; and a method in which a mixture is put into a jet air to collide the particles against each other or a collision board. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Process Cartridge

Figure 2:
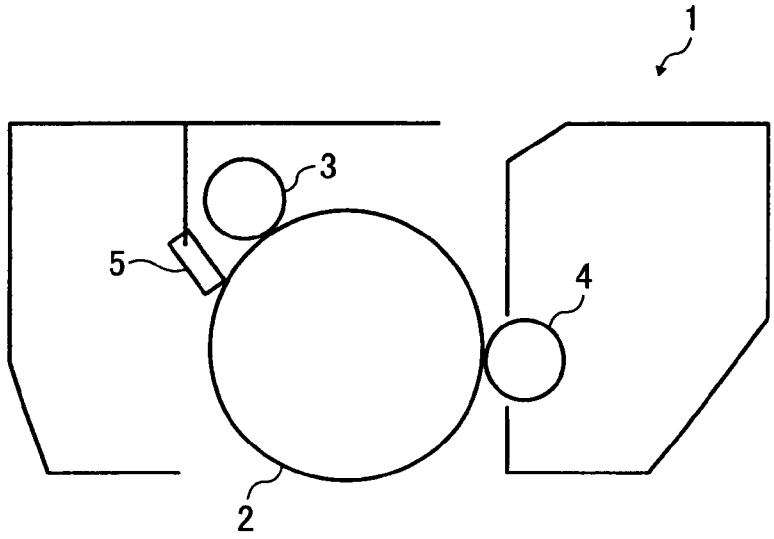
FIG. 2 is a diagram illustrating an example of a process cartridge for use an image forming apparatus using the toner FIG. 1.

Developing agents for use in the subject matter of the present disclosure can be used in, for example, an image forming apparatus having the process cartridge as illustrated in FIG. 2

In the present disclosure, an image bearing member and at least one of the other elements, for example, a charging device, a developing device and a cleaning device, are integrated as a process cartridge and this process cartridge is detachably attached to the main body of an image forming apparatus (e.g.: photocopier, printer).

The process cartridge 1 illustrated in FIG. 2 include an image bearing member 2, a charging device 3, a developing device 4 and a cleaning device 5. In this system, an image bearing member is rotated with a particular peripheral speed. The image bearing member 2 is uniformly charged to a particular voltage with a negative or a positive polarity in its rotation process by the charging device 3. Next, the image bearing member 2 is irradiated by an image irradiation device of, for example, slit irradiation or laser beam scanning irradiation to sequentially form a latent electrostatic image on the surface of the image bearing member 2. The formed latent electrostatic image is developed with toner by a developing device 4. The developed toner image is sequentially transferred to a transfer medium fed from a paper feeder to between the image bearing member 2 and a transfer device in synchronization with the rotation of the image bearing member 2. The transfer medium on which the toner image is transferred is separated from the image bearing member 2 and transferred to a fixing device where the toner image is fixed. Finally, the fixed image is discharged from the image forming apparatus as a photocopy or a print. Toner remaining on the surface of the image bearing member 2 is removed by the cleaning device 5 after the image transfer. Subsequent to discharging, the image bearing member 2 is repetitively used for image formation.

The toner is analyzed and evaluated as follows. In the following, the toner is evaluated as a single component developing agent but can be used as a two-component developing agent with suitable external additive treatment and a suitable carrier.

Measuring Method

Particle Diameter

The measuring method of particle size distribution of toner particles is described below.

Specific example of the measuring device for particle size distribution of toner particles based on Coulter Counter method include COULTER COUNTER TA-II and COULTER MULTI-SIZER II (both are manufactured by Beckman Coulter Inc.). The measuring method is described below.

(1) Add 0.1 to 5 ml of a surface active agent (preferably a salt of an alkyl benzene sulfide) as a dispersing agent to 100 to 150 ml of an electrolytic aqueous solution. The electrolytic aqueous solution is an about 1% NaCl aqueous solution prepared by using primary NaCl (e.g., ISOTON-II®, manufactured by Beckman Coulter Inc.).

(2) Add 2 to 20 mg of a measuring sample to the electrolytic aqueous solution.

(3) The electrolytic aqueous solution in which the measuring sample is suspended is subject to a dispersion treatment for 1 to 3 minutes with a supersonic disperser.

(4) Measure the volume and the number of toner particles or toner with the aperture set to 100 μm for the measuring device mentioned above to calculate the volume distribution and the number distribution.

The volume average particle diameter (Dv) and the number average particle diameter (Dp) can be obtained from the obtained distributions.

The whole range is a particle diameter of from 2.00 to not greater than 40.30 μm and the number of the channels is 13. These channels are: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

Average Circularity

An optical detection method can be used for measuring the average circularity of a toner in which particle images are optically detected by a charge coupled device (CCD) camera while a suspension containing the particles passes through an imaging detective portion having a plate form. The average circularity is a value obtained by dividing the circumferential length of the circle having an area corresponding to projected particle area obtained by this method with the circumferential length of the particle.

This value is a value measured as the average circularity measured by a flow particle image analyzer (FPIA-2000, manufactured by Sysmex Corporation). The measuring method is as follows: Add 0.1 to 5 ml of a surface active agent (preferably alkyl benzene sulfonate salt) as a dispersant in 100 to 150 ml of water from which undissolved solid portions in the vessel are removed beforehand; Add about 0.1 to about 0.5 g of the measuring sample; Perform dispersion treatment for the suspension solution in which the sample is dispersed in a supersonic dispersion device for about 1 to about 3 minutes; and measure the form and distribution of the toner by the device mentioned above under the condition that the liquid dispersion density is from 3,000 to 10,000 particles/μl.

Volume Average Particle Diameter of Resin Particulate

The volume average particle diameter of resin particulates can be measured by a particle diameter distribution measuring device nanotrack super particulate size distribution (UPA-EX150, manufactured by Nikkiso Co., Ltd.) based on dynamic light scattering method and laser Doppler method. Specifically, liquid dispersion in which resin particulates are dispersed is adjusted to be in a measuring density range for measurement. Background measurement is performed for liquid solvent of the liquid dispersion beforehand. By this method, it is possible to measure the size from several tens of nm to several μm, which is the range of the volume average particle diameter of the resin particulate for use in the subject matter of the present disclosure.

Molecular Weight

The molecular weight of the polyester resin and the vinyl-based copolymer resin can be measured by a typical gel permeation chromatography (GPC) under the following condition.

Device: HLC-8220GPC (manufactured by Tosoh Corporation)

Column: TSKgel SuperHZM-M×3

Temperature: 40° C.

Solvent: 0.35 ml/minute

Sample: 0.01 ml of sample with a density of 0.05 to 0.6%

The weight average molecular weight Mw is calculated using molecular weight analytical curve manufactured from the molecular weight of toner resin measured under the condition mentioned above by mono-dispersed polystyrene standard sample. As mono-dispersed polystyrene standard samples, ten samples of 5.8×100, 1.085×10,000, 5.95×10,000, 3.2×100,000, 2.56×1,000,000, 2.85×10,000, 1.48×100,000, 8.417×100,000 and 7.5×1,000,000 are used.

Glass Transition Point and Endothermic Amount

With regard to the measurement of glass transition point of, for example, polyester resins and vinyl-based copolymer resins, a differential scanning calorimeter (e.g., DSC-6220R, manufactured by Seiko Instruments Inc.) is used. After raising the temperature from room temperature to 150° C. at a temperature rising speed of 10°/minute, the sample is left at 150° C. for 10 minutes, cooled down to room temperature, left for 10 minutes, heated again to 150° C. at a temperature rising speed of 10°/minute. The glass transition point can be obtained from the baseline below the glass transition point and the curve portion corresponding to where the height of the baseline above the glass transition point is ½.

In addition, the endothermic amount of wax can be measured in the same manner and is obtained by calculating the peak area of the measured endothermic peak. Generally, wax used inside toner is melted at a temperature lower than that of the fixing temperature of the toner. The melting heat appears as the endothermic peak. Some wax has transfer heat by phase transition in solid phase in addition to the melting heat. In the present disclosure, the sum of these is determined to be the endothermic amount.

Evaluation Method

Chargeability Evaluation

Using externally treated toner (developing agent) and ipsio CX2500, a particular print pattern having a B/W ratio of 6% is continuously printed in the environment of 23° C. and 45% humidity. After continuous 50 outputs under this environment, the chargeability of the toner is evaluated by measuring the amount of charge of the toner sucked from the development roller in the middle of printing a white paper pattern by an electrometer.

E: amount of charge is not less than 30 μC/g

G: amount of charge in the range of from 25 to 30 μC/g

F: amount of charge in the range of from 20 to 25 μC/g

B: amount of charge is not greater than 20 μC/g

Anti-Stress Evaluation

Using externally treated toner (developing agent) and ipsio CX2500, a particular print pattern having a B/W ratio of 6% is continuously printed in the environment of 23° C. and 45% humidity. After continuous 2,000 outputs (durability) under this environment, the chargeability of the toner is evaluated after 50 outputs and 2,000 outputs by measuring the amount of charge of the toner sucked from the development roller in the middle of printing a white paper pattern by an electrometer.

E: difference in amount of charge is not greater than 5 μC/g

G: difference in amount of charge in the range of from 5 to 10 μC/g

F: difference in amount of charge in the range of from 10 to 15 μC/g

B: difference in amount of charge is not less than 15 μC/g

Image Fouling Evaluation

Using externally treated toner (developing agent) and ipsio CX2500, a particular print pattern having a B/W ratio of 6% is continuously printed in the environment of 23° C. and 45% humidity. After continuous 2,000 outputs under this environment, a test pattern is printed to evaluate the image fouling. The evaluation is made in light of toner streak and black spots in white portion and white-out streak and white out in the solid image portion.

E: No image fouling

G: image fouling found on 1 or 2 spots

F: image fouling found on 3 to 5 spots

B: image fouling found on 6 or more spots

Fixing Separation Evaluation

Using externally treated toner (developing agent) and ipsio CX2500, a non-fixed solid band image (amount of attached: 11 g/cm$^2$) is printed at 3 mm from one end of an A4 portrait with a width of 36 mm. This non-fixed image is fixed by the following fixing device in the range of from 115 to 175° C. at an interval of 10° to obtain separable/non-offset temperature range. This temperature range represents the fixing temperature range in which paper is separated well and offset phenomenon does not occur. The paper used and the passing direction thereof is 45 g/m$^2$, Y, landscape. The peripheral speed of the fixing device is set to be 180 mm/sec.

Figure 3:
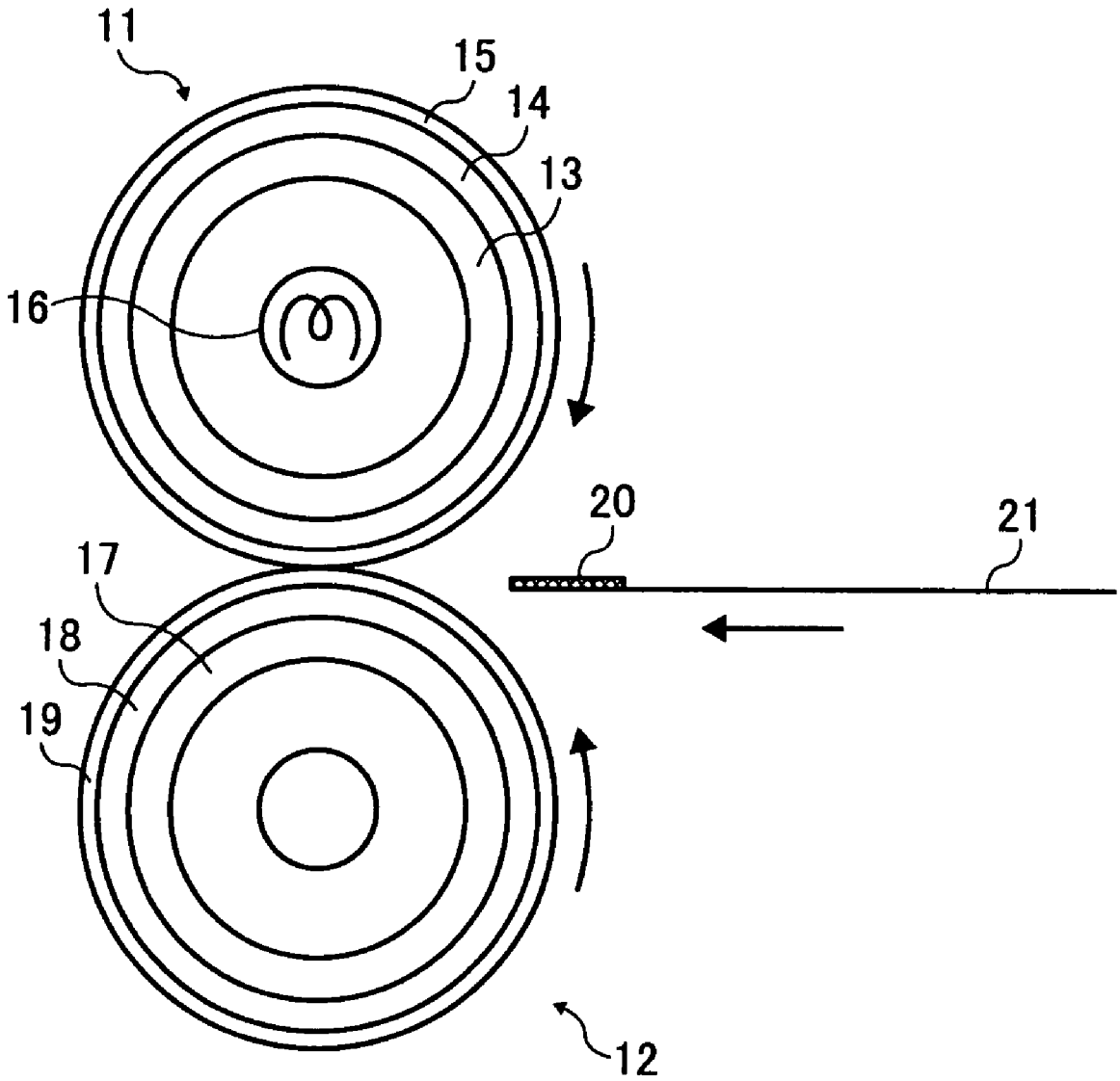
FIG. 3 is a diagram illustrating an example of a fixing device for use in an image forming apparatus using the toner of FIG. 1.

The fixing device is a soft roller type illustrated in FIG. 3 having a fluorine-based surface layer structure. Specifically, a heat roller 11 has an outer parameter of 40 mm and an aluminum core metal 13 on which an elastic layer 14 formed of silicone rubber having a thickness of 1.5 mm and a surface layer 15 formed of tetrafluoroethylene perfluoroalkyl vinyl ether copolymer (PFA) are provided. There is provided a heater 16 inside the aluminum core metal 13. A press roller 12 has an outer parameter of 40 mm and an aluminum core metal 17 on which an elastic layer 18 formed of silicone rubber having a thickness of 1.5 mm and a surface layer 19 formed of PFA are provided. A paper 21 on which a non-fixed image 20 is printed passes through as illustrated in FIG. 3.

E: separable/non-offset in the entire temperature range of from 115 to 175° C. and sufficient in fixed image durability.

G: separable/non-offset in the entire temperature range of from 115 to 175° C. but a fixed image in a low temperature range is easily removed by scratch and damaged.

F: separable/non-offset temperature range is from 30 to lower than 50° C.

B: separable/non-offset temperature range is lower then 30° C.

High Temperature Preservability

Toner is preserved at 50° C. for 8 hours and then sieved by a 42 mesh sieve for 2 minutes. The remain ratio on the mesh is determined as the index of high temperature preservability. The high temperature preservability is evaluated by the following 4 scales.

E: less than 10%

G: 10 to 20%

F: 20 to 30%

B: not less than 30%

Having generally described preferred embodiments of the subject matter of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Non-Crystalline Polyester Resin (1)

The following recipe is placed in a 1 L flask and reacted at 170° C. for 5 hours in nitrogen atmosphere followed by polycondensation reaction at 220° C. with a reduced pressure. In the middle of the reaction, polymer is sampled and when the molecular weight is 7,000 (Mw) and 4,000 (Mn) by GPC, the reaction is stopped and non-crystalline polyester resin (1) is obtained. The glass transition temperature (Tg) is 52° C. by DSC.

| | |
|---|---|
| Dimethyl terephthalate | 170 g |
| Dimethyl isophthalate 5-sodium sulfonate | 40.1 g |
| Propylene glycol | 106.5 g |
| Dipropylene glycol | 53.6 g |
| Diethylene glycol | 21.2 g |
| Dibutyl tin oxide | 0.07 g |

Synthesis of Non-Crystalline Polyester Resin (2)

The following recipe is placed in a 1 L flask and reacted at 170° C. for 5 hours in nitrogen atmosphere followed by polycondensation reaction at 220° C. with a reduced pressure. In the middle of the reaction, polymer is sampled and when the molecular weight is 5,800 (Mw) and 2,800 (Mn) by GPC, the reaction is stopped and non-crystalline polyester resin (2) is obtained. The glass transition temperature (Tg) is 55° C. by DSC.

| | |
|---|---|
| Dimethyl terephthalate | 93 g |
| Dimethyl isophthalate | 93 g |
| Dimethyl fumarate | 6 g |
| Dimethyl isophthalate 5-sodium sulfonate | 8.2 g |
| Neopentyl glycol | 80 g |
| Ethylene glycol | 89 g |
| Dibutyl tin oxide | 0.1 g |

Synthesis of Non-Crystalline Polyester Resin (3)

The following recipe is placed in a 1 L flask and reacted at 190° C. for 5 hours in nitrogen atmosphere followed by polycondensation reaction at 240° C. with a reduced pressure. In the middle of the reaction, polymer is sampled and when the molecular weight is 9,000 (Mw) and 4,600 (Mn) by GPC, the reaction is stopped and non-crystalline polyester resin (3) is obtained. The glass transition temperature (Tg) is 61° C. by DSC.

| | |
|---|---|
| Terephthalic acid | 96 g |
| Neopentyl glycol | 65 g |
| Ethylene glycol | 49 g |
| Dibutyl tin oxide | 0.1 g |

Synthesis of Crystalline Polyester Resin (1)

The following recipe is placed in a 5 L flask and reacted at 170° C. for 5 hours in nitrogen atmosphere followed by polycondensation reaction at 220° C. with a reduced pressure. In the middle of the reaction, polymer is sampled and when the molecular weight is 9,600 (Mw) and 4,400 (Mn) by GPC, the reaction is stopped and crystalline polyester resin (1) is obtained. The melting point (peak top of DSC) is 71° C.

| | |
|---|---|
| Sebacic acid | 1,982 g |
| Ethylene glycol | 1,490 g |
| Dimethyl isophthalate 5-sodium sulfonate | 59.2 g |
| Dibutyl tin oxide | 0.8 g |

Synthesis of Crystalline Polyester Resin (2)

The following recipe is placed in a 5 L flask and reacted at 170° C. for 5 hours in nitrogen atmosphere followed by polycondensation reaction at 220° C. with a reduced pressure. In the middle of the reaction, polymer is sampled and when the molecular weight is 3,500 (Mw) and 2,500 (Mn) by GPC, the reaction is stopped and crystalline polyester resin (2) is obtained. The melting point (peak top of DSC) is 66° C.

| | |
|---|---|
| 1,10-dodecane 2 acid | 1,842 g |
| 1,9-nonane diol | 1,362 g |
| Dimethyl isophthalate 5-sodium sulfonate | 148 g |
| Dibutyl tin oxide | 0.7 g |

Preparation of Liquid Dispersion B-1 of Cyan Pigment

The following recipe is mixed and dissolved and the mixed solution is dispersed by HOMOGENIZER (ULTRA TARRUX, manufactured by IKA Group) and irradiation of supersonic wave to obtain liquid dispersion B-1 of blue pigment having a center particle diameter of 150 nm.

Cyan pigment C.I. Pigment Blue 15 (Copper phthalocyanine, manufactured by Dainippon Ink and Chemicals, Incorporated) 350 g

| | |
|---|---|
| Anionic surface active agent Neogen SC | 5 g |
| Deionized water | 200 g |

Preparation of Liquid Dispersion C-1 of Releasing Agent

The following recipe is mixed and heated to 97° C. and the mixture is dispersed by ULTRA TARRUX T50 (manufactured by IKA Group) followed by dispersion treatment by (manufactured by Meiwafosis Co., Ltd.). This treatment is repeated 20 times at 105° C. and 550 kg/cm$^2$ to obtain liquid dispersion C-1 of releasing agent having a center particle diameter of 190 nm.

| | |
|---|---|
| Paraffin wax (HNP-09, manufactured by NOF CORPORATION) | 100 g |
| Anionic surface active agent Neogen SC | 5 g |
| Deionized water | 300 g |

Manufacturing of Non-Crystalline Polyester Resin Latex (1)

Non-crystalline polyester resin latex (1) is manufactured as follows: add 40 g of the obtained non-crystalline polyester resin (1) to 360 g of deionized water; heat the resultant to 90° C.; adjust pH of the resultant to be 7 by 5% ammonium water; and stir the resultant at 8,000 rpm using ULTRA TURRAX T50 (manufactured by IKA group) while adding 0.8 g of aqueous solution of 10% dodecyl benzene sulfonic acid to obtain non-crystalline polyester resin latex (1) having a center particle diameter of 260 nm.

Manufacturing of Non-crystalline Polyester Resin Latex (2)

Non-crystalline polyester resin latex (2) is manufactured as follows: add 40 g of the obtained non-crystalline polyester resin (2) to 360 g of deionized water; heat the resultant to 90° C.; adjust pH of the resultant to be 7 by 5% ammonium water; and stir the resultant at 8,000 rpm using ULTRA TURRAX T50 (manufactured by IKA group) while adding 0.8 g of aqueous solution of 10% dodecyl benzene sulfonic acid to obtain non-crystalline polyester resin latex (2) having a center particle diameter of 310 nm.

Manufacturing of Non-Crystalline Polyester Resin Latex (3)

Non-crystalline polyester resin latex (3) is manufactured as follows: add 40 g of the obtained non-crystalline polyester resin (3) to 360 g of deionized water; heat the resultant to 94° C.; adjust pH of the resultant to be 7 by 5% ammonium water; and stir the resultant at 8,000 rpm using ULTRA TURRAX T50 (manufactured by IKA group) while adding 0.8 g of aqueous solution of 10% dodecyl benzene sulfonic acid to obtain non-crystalline polyester resin latex (3) having a center particle diameter of 320 nm.

Manufacturing of Crystalline Polyester Resin Latex (1)

Crystalline polyester resin latex (1) is manufactured as follows: add 40 g of the obtained non-crystalline polyester resin (1) to 360 g of deionized water; heat the resultant to 90° C.; adjust pH of the resultant to be 7 by 5% ammonium water; and stir the resultant at 8,000 rpm using ULTRA TURRAX T50 (manufactured by IKA group) while adding 0.8 g of aqueous solution of 10% dodecyl benzene sulfonic acid to obtain crystalline polyester resin latex (1) having a center particle diameter of 300 nm.

Manufacturing of Crystalline Polyester Resin Latex (2)

Crystalline polyester resin latex (2) is manufactured as follows: add 40 g of the obtained crystalline polyester resin (2) to 360 g of deionized water; heat the resultant to 90° C.; adjust pH of the resultant to be 7 by 5% ammonium water; and stir the resultant at 8,000 rpm using ULTRA TURRAX T50 (manufactured by IKA group) while adding 0.8 g of aqueous solution of 10% dodecyl benzene sulfonic acid to obtain crystalline polyester resin latex (2) having a center particle diameter of 290 nm.

Manufacturing of Non-Crystalline Styrene-Acryl Latex (1)

The following recipe is mixed and dissolved and the mixed solution is dispersed and emulsified in a flask in a solution in which 6 parts of nonionic surface active agent (Nonipole 400, manufactured by Sanyo Chemical Industries Co., Ltd.) and 10 parts of anionic surface active agent (NEOGEN SC, manufactured by Dai-ichi kogyo seiyaku Co., Ltd.) are dissolved in 560 parts of deionized water. The resultant is slowly mixed for 10 minutes and 50 parts of deionized water in which 4 parts of ammonium persulfate is dissolved is put therein. Subsequent to nitrogen substitution, the content in the flask is heated to 70° C. by oil-bath while the content is stirred. This emulsification polymerization is continued for 5 hours. Thus, non-crystalline polymer liquid dispersion 1A (resin particle density: 40% by weight) is obtained in which resin particulates having a volume average particle diameter of 180 nm, glass transition point of 59° C. and weight average molecular weight (Mw) of 33,000 are dispersed.

Manufacturing of Latex (1) of Polyester Resin and Styrene-Acryl Resin Containing Wax The following recipe is put in a 500 ml beaker equipped with a temperature sensor, a condenser, and a nitrogen introduction tube and heated to 85° C. for dissolution and dispersion to adjust a monomer solution.

| | |
|---|---|
| Styrene | 124 g |
| n-butylacrylate | 40 g |
| Methacrylic acid | 12.3 g |
| Octane thiol | 0.72 g |
| Non-crystalline polyester resin (2) | 40 g |
| Paraffin wax (HNP-9, manufactured by NOF CORPORATION) | 65 g |

An active agent aqueous solution in which 0.55 g of NEWCOL 2320-SN (manufactured by Nippon Nyukazai Co., Ltd.) is dissolved in 1,000 g of purified water is placed in a 2 L flask equipped with a temperature sensor, a condenser, and a nitrogen introduction tube is heated to 80° C. The monomer solution is added to the active agent aqueous solution and mixed and dispersed for one hour at 80° C. with a mechanical disperser (CLEAMIX, manufactured by M Technique Co., Ltd.). Thereafter, the mechanical disperser is replaced with stirring wings. Aqueous solution of ammonium persulfurate (in which 4.5 g of ammonium persulfurate is dissolved in 250 g of purified water) is put in the flask and the liquid temperature is maintained at 80° C. while stirring under nitrogen atmosphere to conduct a polymerization reaction for two hours. Then, aqueous solution of ammonium persulfurate (in which 0.5 g of ammonium persulfurate is dissolved in 30 g of purified water) is added thereto. After further reaction for two hours, the resultant is cooled down to room temperature to obtain latex (1) having a center particle diameter of 170 nm of polyester resin and styrene-acryl resin containing wax.

Manufacturing of Latex (2) of Polyester Resin and Styrene-acryl Resin Containing Wax The following recipe is put in a 500 ml beaker equipped with a temperature sensor, a condenser, and a nitrogen introduction tube and heated to 85° C. for dissolution and dispersion to adjust a monomer solution.

| | |
|---|---|
| Styrene | 130 g |
| n-butylacrylate | 46 g |
| Methacrylic acid | 9 g |
| Octane thiol | 0.7 g |
| Non-crystalline polyester resin (2) | 45 g |
| Paraffin wax (HNP-9, manufactured by NOF CORPORATION) | 60 g |

An active agent aqueous solution in which 0.55 g of NEWCOL 2320-SN (manufactured by Nippon Nyukazai Co., Ltd.) is dissolved in 1,000 g of purified water is placed in a 2 L flask equipped with a temperature sensor, a condenser, and a nitrogen introduction tube is heated to 80° C. The monomer solution is added to the active agent aqueous solution and mixed and dispersed for one hour at 80° C. with a mechanical disperser (CLEAMIX, manufactured by M Technique Co., Ltd.). Thereafter, the mechanical disperser is replaced with stirring wings. Aqueous solution of ammonium persulfurate (in which 4.5 g of ammonium persulfurate is dissolved in 250 g of purified water) is put in the flask and the liquid temperature is maintained at 80° C. while stirring under nitrogen atmosphere to conduct a polymerization reaction for two hours. Then, aqueous solution of ammonium persulfurate (in which 0.5 g of ammonium persulfurate is dissolved in 30 g of purified water) is added thereto. After further reaction for two hours, the resultant is cooled down to room temperature to obtain latex (2) having a center particle diameter of 200 nm of polyester resin and styrene-acryl resin containing wax.

Manufacturing of Latex (3) of Polyester Resin and Styrene-Acryl Resin Containing Wax The following recipe is put in a 500 ml beaker equipped with a temperature sensor, a condenser, and a nitrogen introduction tube and heated to 85° C. for dissolution and dispersion to adjust a monomer solution.

| | |
|---|---|
| Styrene | 135 g |
| n-butylacrylate | 45 g |
| Methacrylic acid | 8 g |
| Octane thiol | 0.7 g |
| Non-crystalline polyester resin (2) | 55 g |
| Paraffin wax (HNP-9, manufactured by NOF CORPORATION) | 55 g |

An active agent aqueous solution in which 0.55 g of NEWCOL 2320-SN (manufactured by Nippon Nyukazai Co., Ltd.) is dissolved in 1,000 g of purified water is placed in a 2 L flask equipped with a temperature sensor, a condenser, and a nitrogen introduction tube is heated to 80° C. The monomer solution is added to the active agent aqueous solution and mixed and dispersed for one hour at 80° C. with a mechanical disperser (CLEAMIX, manufactured by M Technique Co., Ltd.). Thereafter, the mechanical disperser is replaced with stirring wings. Aqueous solution of ammonium persulfurate (in which 4.5 g of ammonium persulfurate is dissolved in 250 g of purified water) is put in the flask and the liquid temperature is maintained at 80° C. while stirring under nitrogen atmosphere to conduct a polymerization reaction for two hours. Then, aqueous solution of ammonium persulfurate (in which 0.5 g of ammonium persulfurate is dissolved in 30 g of purified water) is added thereto. After further reaction for two hours, the resultant is cooled down to room temperature to obtain latex (3) having a center particle diameter of 210 nm of polyester resin and styrene-acryl resin containing wax.

Manufacturing of Latex (4) of Polyester Resin and Styrene-Acryl Resin Containing Wax)

The following recipe is put in a 500 ml beaker equipped with a temperature sensor, a condenser, and a nitrogen introduction tube and heated to 85° C. for dissolution and dispersion to adjust a monomer solution.

| | |
|---|---|
| Styrene | 120 g |
| n-butylacrylate | 41 g |
| Methacrylic acid | 13 g |
| Octane thiol | 0.6 g |
| Non-crystalline polyester resin (1) | 10 g |
| Non-crystalline polyester resin (2) | 45 g |
| Paraffin wax (HNP-9, manufactured by NOF CORPORATION) | 15 g |

An active agent aqueous solution in which 0.55 g of NEWCOL 2320-SN (manufactured by Nippon Nyukazai Co., Ltd.) is dissolved in 1,000 g of purified water is placed in a 2 L flask equipped with a temperature sensor, a condenser, and a nitrogen introduction tube is heated to 80° C. The monomer solution is added to the active agent aqueous solution and mixed and dispersed for one hour at 80° C. with a mechanical disperser (CLEAMIX, manufactured by M Technique Co., Ltd.). Thereafter, the mechanical disperser is replaced with stirring wings. Aqueous solution of ammonium persulfurate (in which 4.5 g of ammonium persulfurate is dissolved in 250 g of purified water) is put in the flask and the liquid temperature is maintained at 80° C. while stirring under nitrogen atmosphere to conduct a polymerization reaction for two hours. Then, aqueous solution of ammonium persulfurate (in which 0.5 g of ammonium persulfurate is dissolved in 30 g of purified water) is added thereto. After further reaction for two hours, the resultant is cooled down to room temperature to obtain latex (4) having a center particle diameter of 220 nm of polyester resin and styrene-acryl resin containing wax.

Manufacturing of Dispersion Body (1) of Wax and Polyester Resin

A solution of wax containing organic resin is prepared by putting the following recipe in a beaker followed by stirring with TK HOMOMIXER (manufactured by Primix Corporation) at 12,000 rpm for uniform dissolution and dispersion.

| | |
|---|---|
| Non-crystalline polyester resin (2) 2 | 20 parts |
| Paraffin wax (HNP-9, manufactured by NOF CORPORATION) | 8 parts |
| Ethyl acetate | 70 parts |
| Methylethyl ketone | 30 parts |

In a flask equipped with a thermometer and a stirrer, an aqueous medium is prepared in which 0.5% by weight of dodecylbenzene sodium sulfonate functioning as a dispersing agent and 0.5% by weight of polyvinyl alcohol are dissolved in 450 parts by weight of deionized water.

The solution of wax containing organic resin is added to the aqueous medium and stirred for 30 minutes using TKHOMOMIXER (manufactured by Primix Corporation) at the rotation number of 10,000 rpm to suspend the solution of wax containing organic resin in the aqueous medium. Thus, O/W type emulsion is, formed. Thereafter, the number of rotation of TK HOMOMIXER is down to 200 rpm and the resultant is heated to 40° C. with a reduced pressure while stirring to remove the organic solvent contained in the O/W type emulsion. Thus, dispersion body (1) having a center particle diameter of 190 nm of wax and polyester resin is obtained.

Manufacturing of Latex (1) of Polyester Resin and Styrene-Acryl Resin

The following recipe is put in a 500 ml beaker equipped with a temperature sensor, a condenser, and a nitrogen introduction tube and heated to 85° C. for dissolution and dispersion to adjust a monomer solution.

| | |
|---|---|
| Styrene | 137 g |
| n-butylacrylate | 45 g |
| Methacrylic acid | 13 g |
| Octane thiol | 0.7 g |
| Non-crystalline polyester resin (2) | 86 g |

An active agent aqueous solution in which 0.55 g of NEWCOL 2320-SN (manufactured by Nippon Nyukazai Co., Ltd.)

is dissolved in 1,000 g of purified water is placed in a 2 L flask equipped with a temperature sensor, a condenser and a nitrogen introduction tube is heated to 80° C. The monomer solution is added to the active agent aqueous solution and mixed and dispersed for one hour at 80° C. with a mechanical disperser (CLEAMIX, manufactured by M Technique Co., Ltd.). Thereafter, the mechanical disperser is replaced with stirring wings. Aqueous solution of ammonium persulfurate (in which 4.5 g of ammonium persulfurate is dissolved in 250 g of purified water) is put in the flask and the liquid temperature is maintained at 80° C. while stirring under nitrogen atmosphere to conduct a polymerization reaction for two hours. Then, aqueous solution of ammonium persulfurate (in which 0.5 g of ammonium persulfurate is dissolved in 30 g of purified water) is added thereto. After further reaction for two hours, the resultant is cooled down to room temperature to obtain latex (1) having a center particle diameter of 180 nm of polyester resin and styrene-acryl resin.

Example 1

Preparation of Toner Particles

The following recipe is sufficiently mixed and stirred in a stainless flask using HOMOGENIZER (ULTRA TURRAX, manufactured by IKA group) and heated to 48° C. in a heater oil bath while stirring to agglomerate particles. When it is confirmed that the particle diameter is 5.6 μm, pH of the system is adjusted to be 6.0 by 0.5 mol/litter aqueous solution of sodium hydrate and the system is heated to 94° C. while continuing stirring. In the middle of temperature rising to 94° C., pH of the system is down to about 5.0 and maintained as is. When the circularity is 0.970, the resultant is cooled down, filtered and sufficiently washed with deionized water followed by separation of solid and liquid by Büchner funnel suction filtration. The resultant is re-dispersed in 3 litter of deionized at 40° C. followed by 15 minute stirring and washing. This washing is repeated 5 times and solid and liquid is separated by Büchner funnel suction filtration. Next, drying is performed in vacuum for 12 hours to obtain a toner particle 1.

| | |
|---|---|
| Latex (1) of non-crystalline polyester resin | 200 parts |
| Latex (1) of polyester resin and styrene-acryl resin containing wax | 60 parts |
| Liquid dispersion B-1 of cyan pigment | 10 parts |
| Polyaluminum chloride | 0.15 parts |
| Purified water | 400 parts |

The volume average particle diameter (Dv) of the toner particle 1 is 5.6 μm and the average circularity thereof is 0.971.

To 100 parts of the toner particle 1, 0.2 parts of forsterite (average secondary particle diameter: 0.39 μm, average primary particle diameter: 80 nm) and 1.3 parts of hydrophobized silica (RX 200) are added followed by mixing treatment by HENSCHEL MIXER. The following evaluation is made.

Durability of Single Component Development)

Each toner is put in a process cartridge of ipsio CX 2500 (manufactured by Ricoh Co., Ltd.). The transfer phase on the developing roller is observed when the development roller is rotated at 300 rpm for 60 minutes in an environment of 24° C. and humidity of 45%. Uniform transfer phase is formed. Thereafter, the process cartridge is put in the main body of ipsio CX2500 and when white sheet pattern is printed on Ricoh NBS PPC type 6200T, the white sheet pattern is printed without a particular matter. The sheet before printing and the white portion on the paper after the white pattern printing are measured by X-RITE 939, the color difference therebetween is 0.3.

Example 2

Preparation of Toner Particle 2 Toner particle 2 having a volume average particle diameter of 5.7 μm and average circularity of 0.972 is prepared from the following recipe in the same manner as in Example 1 suitably changing temperature.

| | |
|---|---|
| Latex (1) of non-crystalline polyester resin | 150 parts |
| Latex (1) of polyester resin and styrene-acryl resin containing wax | 90 parts |
| Liquid dispersion B-1 of cyan pigment | 10 parts |
| Polyaluminum chloride | 0.12 parts |
| Purified water | 420 parts |

Durability of single component development is evaluated by the same method as Example 1. The result is shown in Table 1.

Example 3

Preparation of Toner Particle 3

Toner particle 3 having a volume average particle diameter of 5.5 μm and average circularity of 0.974 is prepared from the following recipe in the same manner as in Example 1 suitably changing temperature.

| | |
|---|---|
| Latex (1) of non-crystalline polyester resin | 230 parts |
| Latex (2) of polyester resin and styrene-acryl resin containing wax | 40 parts |
| Liquid dispersion B-1 of cyan pigment | 10 parts |
| Polyaluminum chloride | 0.16 parts |
| Purified water | 390 parts |

Durability of single component development is evaluated by the same method as Example 1. The result is shown in Table 1.

Example 4

Preparation of Toner Particle 4

Toner particle 4 having a volume average particle diameter of 5.9 μm and average circularity of 0.973 is prepared from the following recipe in the same manner as in Example 1 suitably changing temperature.

| | |
|---|---|
| Latex (1) of non-crystalline polyester resin | 80 parts |
| Latex (1) of crystalline polyester resin | 120 parts |
| Latex (1) of polyester resin and styrene-acryl resin containing wax | 65 parts |
| Liquid dispersion B-1 of cyan pigment | 11 parts |
| Polyaluminum chloride | 0.13 parts |
| Purified water | 394 parts |

Durability of single component development is evaluated by the same method as Example 1. The result is shown in Table 1.

Example 5

Preparation of toner particle 5

The following recipe is sufficiently mixed and stirred in a stainless flask using HOMOGENIZER (ULTRA TURRAX, manufactured by IKA group) and heated to 48° C. in a heater oil bath while stirring to agglomerate particles. When the particle diameter is 2.8 μm, 5 parts of latex (1) of non-crystalline polyester resin is added to attach non-crystalline polyester resin particulates to the surface of agglomerated body. When it is confirmed that the particle diameter is 6.0 μm, pH of the system is adjusted to be 6.0 by 0.5 mol/litter aqueous solution of sodium hydrate and the system is heated to 94° C. while continuing stirring. In the middle of temperature rising to 94° C., pH of the system is down to about 5.0 and maintained as is. When the circularity is 0.974, the resultant is cooled down, filtered and sufficiently washed with deionized water followed by separation of solid and liquid by Büchner funnel suction filtration. The resultant is re-dispersed in 3 litter of deionized at 40° C. followed by 15 minute stirring and washing. This washing is repeated 5 times and solid and liquid is separated by Büchner funnel suction filtration. Next, drying is performed in vacuum for 12 hours to obtain a toner particle 5.

| | |
|---|---|
| Latex (1) of crystalline polyester resin | 160 parts |
| Latex (1) of non-crystalline polyester resin | 20 parts |
| Latex (3) of polyester resin and styrene-acryl resin containing wax | 65 parts |
| Liquid dispersion B-1 of cyan pigment | 10 parts |
| Polyaluminum chloride | 0.14 parts |
| Purified water | 400 parts |

The volume average particle diameter (Dv) of the toner particle 1 is 5.9 μm and the average circularity thereof is 0.976.

To 100 parts of the toner particle 5, 0.2 parts of forsterite (average secondary particle diameter: 0.39 μm, average primary particle diameter: 80 nm) and 1.3 parts of hydrophobized silica (RX 200) are added followed by mixing treatment by HENSCHEL MIXER. The same evaluation is made as in Example 1. The result is shown in Table 1.

Example 6

Preparation of Toner Particle 6

The following recipe is sufficiently mixed and stirred in a stainless flask using HOMOGENIZER (ULTRA TURRAX, manufactured by IKA group) and heated to 48° C. in a heater oil bath while stirring to agglomerate particles. When it is confirmed that the particle diameter is 5.9 μm, pH of the system is adjusted to be 6.0 by 0.5 mol/litter aqueous solution of sodium hydrate and the system is heated to 94° C. while continuing stirring. In the middle of temperature rising to 94° C., pH of the system is down to about 5.0 and maintained as is. When the circularity is 0.970, the resultant is cooled down, filtered and sufficiently washed with deionized water followed by separation of solid and liquid by Büchner funnel suction filtration. The resultant is re-dispersed in 3 litter of deionized at 40° C. followed by 15 minute stirring and washing. This washing is repeated 5 times and solid and liquid is separated by Büchner funnel suction filtration. Next, drying is performed in vacuum for 12 hours to obtain a toner particle 5.

| | |
|---|---|
| Latex (1) of non-crystalline polyester resin | 190 parts |
| Latex (3) of non-crystalline polyester resin | 50 parts |
| Latex (1) of polyester resin and styrene-acryl resin containing wax | 20 parts |
| Liquid dispersion B-1 of cyan pigment | 10 parts |
| Polyaluminum chloride | 0.15 parts |
| Purified water | 390 parts |

Comparative Example 1

Preparation of Toner Particle 101

The following recipe is sufficiently mixed and stirred in a stainless flask using HOMOGENIZER (ULTRA TURRAX, manufactured by IKA group) and heated to 48° C. in a heater oil bath while stirring to agglomerate particles. When it is confirmed that the particle diameter is 5.7 μm, pH of the system is adjusted to be 6.0 by 0.5 mol/litter aqueous solution of sodium hydrate and the system is heated to 94° C. while continuing stirring. In the middle of temperature rising to 94° C., pH of the system is down to about 5.0 and maintained as is. When the circularity is 0.970, the resultant is cooled down, filtered and sufficiently washed with deionized water followed by separation of solid and liquid by Büchner funnel suction filtration. The resultant is re-dispersed in 3 litter of deionized at 40° C. followed by 15 minute stirring and washing. This washing is repeated 5 times and solid and liquid is separated by Büchner funnel suction filtration. Next, drying is performed in vacuum for 12 hours to obtain a toner particle 101.

| | |
|---|---|
| Latex (1) of non-crystalline polyester resin | 200 parts |
| Latex (1) of polyester resin and styrene-acryl resin | 60 parts |
| Liquid dispersion C-1 of releasing agent | 10 parts |
| Liquid dispersion B-1 of cyan pigment | 11 parts |
| Polyaluminum chloride | 0.15 parts |
| Purified water | 400 parts |

The volume average particle diameter (Dv) of the toner particle 101 is 5.6 μm and the average circularity thereof is 0.972.

To 100 parts of the toner particle 5, 0.2 parts of forsterite (average secondary particle diameter: 0.39 μm, average primary particle diameter: 80 nm) and 1.3 parts of hydrophobized silica (RX 200) are added followed by mixing treatment by HENSCHEL MIXER. The same evaluation is made as in Example 1. Streaks appears all over the transfer phase of the developing roller after the durable test and toner is spilt from the developing device. The spilt toner is suctioned and removed. The developing device is installed to the main body of ipsio CX 2500 and when white sheet pattern is printed on Ricoh NBS PPC type 6200T, the white portion is printed in blue with streaks. The sheet before printing and the white portion on the paper after the white pattern printing are measured by X-RITE 939, the color difference therebetween is 1.1. The toner remaining in the developing device is retrieved and the particle diameter is measured again. The volume average particle diameter is 5.2 μm, which means that fine powder increases.

Comparative Example 2

Preparation of Toner Particle 102

Toner particle 102 having a volume average particle diameter of 5.9 μm and average circularity of 0.969 is prepared from the following recipe in the same manner as in Example 1 suitably changing temperature.

| | |
|---|---|
| Latex (1) of non-crystalline styrene-acryl resin | 90 parts |
| Liquid dispersion C-1 of releasing agent | 10 parts |
| Liquid dispersion B-1 of cyan pigment | 12 parts |
| Polyaluminum chloride | 0.16 parts |
| Purified water | 550 parts |

Durability of single component development is evaluated by the same method as Example 1. The result is shown in Table 1.

Comparative Example 3

Preparation of Toner Particle 103

Toner particle 103 having a volume average particle diameter of 6.1 μm and average circularity of 0.970 is prepared from the following recipe in the same manner as in Example 1 suitably changing temperature.

| | |
|---|---|
| Latex (4) of polyester resin and styrene-acryl resin containing wax | 190 parts |
| Liquid dispersion B-1 of cyan pigment | 10 parts |
| Polyaluminum chloride | 0.15 parts |
| Purified water | 460 parts |

Durability of single component development is evaluated by the same method as Example 1. The result is shown in Table 1. Comparative Example 4 (Manufacturing method of suspension polymerization toner)

360 parts of deionized water and 430 parts of 0.1 M aqueous solution of sodium phosphate are placed in a vessel and the temperature is maintained at 60° C. while stirring at 15,000 rpm using a high speed stirrer HOMOMIXER. 34 parts of 1 M aqueous solution of calcium chloride is gradually added to prepare an aqueous liquid dispersion containing calcium phosphate functioning as fine dispersion stabilizer having poor water solubility. The following recipe is dispersed as dispersoid for 3 hours using an attritor (manufactured by Mitsui Mineral and Smelting Co., Ltd.) followed by addition of 3 parts of 2,2'azobis (2,4-dimethyl valeronitrile) to prepare a monomer composition.

| | |
|---|---|
| Styrene | 83 parts |
| n-butyl acrylate | 17 parts |
| Copper phthalocyanine pigment | 5 parts |
| Aluminum salicylate | 2.5 parts |
| Divinyl benzene | 0.05 parts |
| Paraffin wax (HNP-9, manufactured by NOF corporation) | 7 parts |
| Non-crystalline polyester resin (3) | 5 parts |

Next, the monomer composition is added in the aqueous liquid dispersion and stirred for 4 minutes maintaining the rotation speed of the high speed stirrer at 15,000 rpm under nitrogen atmosphere at 60° C. to granulate a monomer composition. Thereafter, the high speed stirrer is replaced with a stirrer having a paddle stirring wing. The system is maintained at 60° C. for 5 hour polymerization while stirring at 200 rpm.

Thereafter, the system is heated to 80° C. for further polymerization. Subsequent to cooling down, dilute hydrochloric acid is added to make pH 1.2 to dissolve calcium phosphate. Furthermore, after pressured filtration of solid and liquid are separated, the resultant is washed with 18,000 parts of water. Thereafter, using a vacuum dryer, the resultant is dried to obtain toner particle 104 having a volume average particle diameter of 7.0 μm and an average circularity of 0.979.

Durability of single component development is evaluated by the same method as Example 1. The result is shown in Table 1.

Comparative Example 5

Preparation of Toner Particle 10576

Liquid dispersion is prepared by dispersing the following recipe by a sand mill.

| | |
|---|---|
| Non-crystalline polyester resin (3) | 40 parts |
| Copper phthalocyanine (C.I. Pigment blue 15:3) | 5 parts |
| Paraffin wax (HNP-9, manufactured by NOF Corporation) | 3 parts |
| Toluene | 90 parts |

50 parts of liquid suspension of 40% by weight calcium carbonate and 60 parts of water are added to 36 parts of 3.0% by weight carboxymethylcelluose.

All the amount of the liquid dispersion is added thereto at 50° C. The resultant is stirred at 10,000 rpm for 3 minutes by an emulsifying device (ULTRA TURRAX, manufactured by Junke & Kunkel) at 50° C. to obtain a liquid suspension.

Next, under nitrogen atmosphere, toluene and water are vaporized as much as possible to obtain particle liquid dispersion. About 5 times as much as water is added to the obtained particle liquid dispersion and calcium carbonate is dissolved by hydrochloric acid followed by repeated water-washing. Toner particle 105 having a volume particle diameter of 6.6 μm and an average circularity of 0.978 is obtained after reduced pressure and freeze dry.

Durability of single component development is evaluated by the same method as Example 1. The result is shown in Table 1.

TABLE 1

| | | | | Development durability | | | |
|---|---|---|---|---|---|---|---|
| | Dv (μm) | Circularity | Ratio (wt %) of polyester resin in toner | Dv (μm) | Color difference at white portion | Transfer phase of developing roller | Spilt toner |
| Example 1 | 5.6 | 0.971 | 66 | 5.6 | 0.2 | E | E |
| Example 2 | 5.7 | 0.972 | 52 | 5.5 | 0.3 | G | E |
| Example 3 | 5.5 | 0.974 | 75 | 5.5 | 0.1 | E | E |
| Example 4 | 5.9 | 0.973 | 64 | 5.7 | 0.5 | G | G |
| Example 5 | 5.9 | 0.976 | 63 | 5.8 | 0.3 | G | E |
| Example 6 | 5.9 | 0.972 | 83 | 5.8 | 0.2 | E | E |
| Comparative Example 1 | 5.6 | 0.972 | 66 | 5.2 | 1.1 | B | B |
| Comparative Example 2 | 5.9 | 0.969 | 0 | 5.2 | 1.3 | B | B |
| Comparative Example 3 | 6.1 | 0.970 | 21 | 5.4 | 1.0 | B | B |
| Comparative Example 4 | 7.0 | 0.979 | 4 | 6.6 | 1.2 | F | B |

TABLE 1-continued

| | Dv (μm) | Circularity | Ratio (wt %) of polyester resin in toner | Development durability: Dv (μm) | Development durability: Color difference at white portion | Development durability: Transfer phase of developing roller | Development durability: Spilt toner |
|---|---|---|---|---|---|---|---|
| Comparative Example 5 | 6.6 | 0.978 | 83 | 6.2 | 1.0 | F | F |

Transfer phase of developing roller
E: uniform transfer phase is formed
G: slightly uneven portion observed but transfer phase formed
F: several streaks formed on the end portion
B: Streaks observed all over the transfer phase
Toner spill
E: No toner spill
G: Slight amount of toner spill at the end portions
F: Slight amount of toner spill all over
B: significant amount of toner spill Synthesis of Polyester Polyester 1

The following components are contained in a reaction container equipped with a condenser, stirrer and a nitrogen introducing tube to conduct a reaction at 230° C. under normal pressure for 8 hours followed by another reaction with a reduced pressure of 10 to 15 mmHg for 5 hours:

| | |
|---|---|
| Adduct of bisphenol A with 2 mol of ethylene oxide | 553 parts |
| Adduct of bisphenol A with 2 mol of propylene oxide | 196 parts |
| Terephtahlic acid | 220 parts |
| Adipic acid | 45 parts |
| Dibutyl tin oxide | 2 parts |

26 parts of trimellitic anhydride is added in the container to conduct a reaction at 180° C. under normal pressure for 2 hours and obtain polyester resin 1. The number average molecular weight of polyester 1 is 4,500, the weight average molecular weight is 5,600, the glass transition temperature is 43° C. and the acid value is 24.

Vinyl-Based Copolymer Resin Particulate V-1

1.6 parts of dodecyl sodium sulfate and 492 parts of deionized water are contained in a reaction container equipped with a condenser, stirrer and a nitrogen introducing tube and heated to 80° C. Then a solution in which 2.5 parts of potassium peroxodisulfate is dissolved in 100 parts of deionized water is added to the container. 15 minutes thereafter, a mixture of 152 parts of styrene monomer, 38 parts of butylacrylate, 10 parts of methacrylic acid, and 3.5 parts of n-octylmercaptan is dropped to the container in 90 minutes. The system is kept at 80° C. for 60 minutes. Subsequent to cooling down, liquid dispersion of vinyl-based copolymer resin particulate V-1 is obtained. The density of the solid portion of this liquid dispersion is measured, which is 25%. In addition, the average particle diameter is 50 nm. A small amount of the liquid dispersion is taken in a petri dish and the solvent is evaporated to obtain solid portion. The number average molecular weight thereof 1 is 11,500, the weight average molecular weight is 18,000 and the glass transition temperature is 65° C.

Vinyl-Based Copolymer Resin Particulate V-2

1.2 parts of dodecyl sodium sulfate and 492 parts of deionized water are contained in a reaction container equipped with a condenser, stirrer and a nitrogen introducing tube and heated to 80° C. Then, a solution in which 2.5 parts of potassium peroxodisulfate is dissolved in 100 parts of deionized water is added to the container. 15 minutes thereafter, a mixture of 150 parts of styrene monomer, 30 parts of butylacrylate, 20 parts of methacrylic acid, and 3 parts of n-octylmercaptan is dropped to the container in 90 minutes. The system is kept at 80° C. for 60 minutes. Subsequent to cooling down, liquid dispersion of vinyl-based copolymer resin particulate V-2 is obtained. The density of the solid portion of this liquid dispersion is measured, which is 25%. In addition, the average particle diameter is 80 nm. A small amount of the liquid dispersion is taken in a petri dish and the solvent is evaporated to obtain solid portion. The number average molecular weight thereof 1 is 14,000, the weight average molecular weight is 29,000 and the glass transition temperature is 69° C.

Vinyl-based Copolymer Resin Particulate V-3

800 parts of vinyl-based copolymer resin particulate V-1, 0.5 parts of dodecyl sodium sulfate and 750 parts of deionized water are contained in a reaction container equipped with a condenser, stirrer and a nitrogen introducing tube. While heating to 80° C., a solution in which 1.2 parts of potassium peroxodisulfate is dissolved in 50 parts of deionized water is added to the container. 15 minutes thereafter, liquid dispersion prepared by preparatorily dispersing with a dispersion device (CLEAR MIX) for 60 minutes a mixture of 76 parts of styrene monomer, 19 parts of butylacrylate, 5 parts of methacrylic acid, 1.5 parts of n-octylmercaptan and 30 parts of paraffin wax (melting point: 72° C.) is dropped to the container in 90 minutes. The system is kept at 80° C. for 60 minutes. Subsequent to cooling down, while the system is heated again to 80° C., solution in which 2 parts of potassium peroxodisulfate is dissolved in 100 parts of deionized water is added in the container. 15 minutes thereafter, a mixture of 130 parts of styrene monomer, 32 parts of butylacrylate, 8.5 parts of methacrylic acid, 3 parts of n-octylmercaptan is dropped to the container in 90 minutes. The system is kept at 80° C. for 60 minutes. Subsequent to cooling down, liquid dispersion of vinyl-based copolymer resin particulate V-3 is obtained. The density of the solid portion of this liquid dispersion is measured, which is 25%. In addition, the average particle diameter is 200 nm. A small amount of the liquid dispersion is taken in a petri dish and the solvent is evaporated to obtain solid portion. Tetrahydrofuran (THF) dissolved portion of the solid portion is measured and the number average molecular weight thereof 1 is 11,500, the weight average molecular weight is 20,000 and the glass transition temperature is 64° C.

Vinyl-based Copolymer Resin Particulate V-4

800 parts of vinyl-based copolymer resin particulate V-1, 0.5 parts of dodecyl sodium sulfate and 750 parts of deionized water are contained in a reaction container equipped with a condenser, stirrer and a nitrogen introducing tube. While heating to 80° C., a solution in which 1.2 parts of potassium peroxodisulfate is dissolved in 50 parts of deionized water is added to the container. 15 minutes thereafter, liquid dispersion prepared by preparatorily dispersing with a dispersion device (CLEAR MIX) for 60 minutes a mixture of 76 parts of styrene monomer, 19 parts of butylacrylate, 5 parts of methacrylic acid, 1.5 parts of n-octylmercaptan and 50 parts of paraffin wax (melting point: 72° C.) is dropped to the container in 90 minutes. The system is kept at 80° C. for 60 minutes. Subsequent to cooling down, while the system is heated again to 80° C., solution in which 2 parts of potassium peroxodisulfate is dissolved in 100 parts of deionized water is added in the container. 15 minutes thereafter, a mixture of 114.5 parts of styrene monomer, 28 parts of butylacrylate, 7.5 parts of methacrylic acid, 3 parts of n-octylmercaptan is dropped to the container in 90 minutes. The system is kept at 80° C. for 60 minutes. Subsequent to cooling down, liquid dispersion of vinyl-based copolymer resin particulate V-4 is obtained. The density of the solid portion of this liquid dispersion is measured, which is 25%. In addition, the average particle diameter is 200 nm. A small amount of the liquid dispersion is taken in a petri dish and the solvent is evaporated to obtain solid portion. Tetrahydrofuran (THF) dissolved portion of the solid portion is measured and the number average molecular weight thereof 1 is 11,000, the weight average molecular weight is 20,000 and the glass transition temperature is 63° C.

Synthesis of Prepolymer

The following components are contained in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain Intermediate body polyester 1:

| | |
|---|---|
| 1,2-propylene glycol | 366 parts |
| Terephthalic acid | 566 parts |
| Trimellitic anhydride | 44 parts |
| Titanium tetrabutoxido | 6 parts |

The obtained Intermediate body polyester 1 has a number average molecular weight of 3,200, a weight average molecular weight of 12,000, a glass transition temperature of 55° C.

Next, the following components are contained in a container equipped with a condenser, a stirrer and a nitrogen introducing tube to conduct a reaction at 100° C. for 5 hours to obtain Prepolymer 1:

| | |
|---|---|
| Intermediate body polyester 1 | 420 parts |
| Isophorone diisocyanate | 80 parts |
| Ethyl acetate | 500 parts |

Prepolymer 1 has an isolated isocyanate weight % of 1.34%.

Example 7

Manufacturing of Liquid Dispersion of Wax (Oil Phase)

The following is placed and mixed in a reaction container equipped with a stirrer and a thermometer:

| | |
|---|---|
| Polyester 1 | 108 parts |
| Paraffin wax (Melting point 72° C.) | 36 parts |
| Ethyl acetate | 206 parts |

The mixture is agitated, heated to 80° C., and kept at 80° C. for 5 hours and then cooled down to 30° C. in 1 hour. Then, the mixture is transferred to another vessel and the wax is dispersed using a bead mill (ULTRAVISCOMILL from AIMEX) under the following conditions to obtain Material solution 1.

Liquid feeding speed: 1 kg/hr,
Disc rotation speed: 6 m/sec
Diameter of zirconia beads: 0.5 mm
Filling factor: 80% by volume
Repeat number of dispersion treatment: 3 times Next, 218 parts of 70% solution of ethyl acetate of Polyester 1 is added to 175 parts of Material solution 1 and stirred with a three one motor for 2 hours to obtain Oil phase 1. Ethyl acetate is added to adjust such that the density of solid portion (measured at 130° C. for 30 minutes) of Oil phase 1 is 50%.

Preparation of Aqueous Phase 877.5 parts of deionized water, 162 parts of 50% aqueous solution of sodium dodecyldiphenyletherdisulfonate (EREMINOR MON-7, manufactured by Sanyo Chemical Industries, Ltd.), 202.5 parts of 1% aqueous solution of carboxymethyl cellulose as viscosity improver and 108 parts of ethyl acetate and a milk white liquid (Aqueous phase 1) is obtained.

Emulsification Process 1.5 parts of isophorone diamine is added to the whole amount of Oil phase 1 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 1.

Removal of Solvent

Emulsion slurry 1 is placed in a container equipped with a stirrer and a thermometer and the solvent is removed at 30° C. for 8 hours to obtain Dispersed slurry 1. The resin particulate (P-1) in the dispersed slurry has a diameter of 1.3 μm.

Manufacturing of Liquid Dispersion of Pigment 24 parts of 50% aqueous solution of sodium dodecyldiphenylether disulfonate (EREMINORMON-7, manufactured by Sanyo Chemical Industries, Ltd.) and 100 parts of carbon black (REGUL 400R, manufactured by Cabot Corporation) are added to 876 parts of deionized water and stirred with a three one motor for one hour. Liquid dispersion of pigment (Liquid dispersion of pigment 1) is prepared by a bead mill (ULTRAVISCOMILL from AIMEX).

Agglomeration Process of Particulate 262.5 parts of Liquid dispersion of pigment 1 and 600 parts of Liquid dispersion of Vinyl-based copolymer resin particulate V-1 are added to Emulsion slurry 1. pH of the system is adjusted to be 10.0 and heated to 65° C. in 30 minutes. A solution in which 17 parts of magnesium chloride hexa hydrate is dissolved in 17 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 1-2.

Washing to Drying

After filtering 1,000 parts of Dispersed slurry 1-2, (1): 1,000 parts of deionized water is added to the filtered cake and the resultant is mixed with a TK HOMOMIXER (rotation at 12,000 rpm for 10 minutes) followed by filtration;

(2): 1,000 parts of deionized is added to the filtered cake prepared in (1) and the resultant is mixed with a TK HOMOMIXER (rotation at 12,000 rpm for 30 minutes) while imparting supersonic wave vibration followed by filtration with a reduced pressure. This is repeated until the electric conductivity of the slurry is not greater than 10 μC/cm.;

(3): 10% hydrochloric acid is added to the re-slurry solution such that pH of the re-slurry solution is 4 and the resultant is stirred by a three one motor, and 30 minutes later, the resultant is filtered.

(4): 1,000 parts of deionized water is added to the filtered cake of (3). The resultant is mixed with a TK HOMOMIXER (rotation at 12,000 rpm for 10 minutes) followed by filtration. This is repeated until the electric conductivity of the slurry is not greater than 10 μC/cm to obtain Filtrated cake 1.

Filtered cake 1 is dried by a drier at 45° C. for 48 hours followed by sieving with a mesh having a mesh size of 75 μm to obtain Mother toner 1. The volume average particle diameter (Dv) is 6.1 μm, the number average particle diameter (Dp) is 5.5 μm, Dv/Dp is 1.11 and the average circularity is 0.973. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 1 of the present disclosure.

Example 8

Manufacturing of Liquid Dispersion of Wax (Oil Phase)

174 parts of 70% solution of ethyl acetate of Polyester 1 is added to 175 parts of Material solution 1 and stirred with a three one motor for 2 hours to obtain Oil phase 2. Ethyl acetate is added to adjust such that the density of solid portion (measured at 130° C. for 30 minutes) of Oil phase 2 is 50%.

Emulsification Process 62.1 parts of Prepolymer 1 and 1.7 parts of isophorone diamine are added to the whole amount of Oil phase 2 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 2.

Removal of Solvent

Emulsion slurry 2 is placed in a container equipped with a stirrer and a thermometer and the solvent is removed at 30° C. for 8 hours to obtain Dispersed slurry 2. The resin particulate (P-2) in the dispersed slurry has a diameter of 1.5 μm.

286 parts of Liquid dispersion of pigment 1 and 736 parts of liquid dispersion of Vinyl-based copolymer resin particulate V-2 are added to Emulsion slurry 2. pH of the system is adjusted to be 10.0 and heated to 65° C. in 30 minutes. A solution in which 19 parts of magnesium chloride hexa hydrate is dissolved in 19 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 2-2. Thereafter, Mother toner 2 is obtained in the same manner as in Example 1 except that Dispersed slurry 1-2 is replaced with Dispersed slurry 2-2. The volume average particle diameter (Dv) is 5.9 μm, the number average particle diameter (Dp) is 5.3 μm, Dv/Dp is 1.11 and the average circularity is 0.971. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 2 of the present disclosure.

Example 9

Manufacturing of Liquid Dispersion of Wax (Oil Phase)

The following is placed and mixed in a reaction container equipped with a stirrer and a thermometer:

| | |
|---|---|
| Polyester 1 | 81 parts |
| Paraffin wax (Melting point 72° C.) | 27 parts |
| Ethyl acetate | 155 parts |

The mixture is agitated, heated to 80° C., and kept at 80° C. for 5 hours and then cooled down to 30° C. in 1 hour. Then, the mixture is transferred to another vessel and the wax is dispersed using a bead mill (ULTRAVISCOMILL from AIMEX) under the following conditions to obtain Material solution 2.

Liquid feeding speed: 1 kg/hr,
Disc rotation speed: 6 m/sec
Diameter of zirconia beads: 0.5 mm
Filling factor: 80% by volume
Repeat number of dispersion treatment: 3 times 244 parts of 70% solution of ethyl acetate of Polyester 1 is added to 131 parts of Material solution 2 and stirred with a three one motor for 2 hours to obtain Oil phase 3. Ethyl acetate is added to adjust such that the density of solid portion (measured at 130° C. for 30 minutes) of Oil phase 3 is 50%.

Emulsification Process 1.6 parts of isophorone diamine is added to the whole amount of Oil phase 3 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 3.

Removal of Solvent

Emulsion slurry 3 is placed in a container equipped with a stirrer and a thermometer and the solvent is removed at 30° C. for 8 hours to obtain Dispersed slurry 3. The resin particulate (P-3) in the dispersed slurry has a diameter of 1.1 μm.

Agglomeration Process of Particulate 210 parts of Liquid dispersion of pigment 1 and 300 parts of Liquid dispersion of Vinyl-based copolymer resin particulate V-1 are added to Emulsion slurry 3. pH of the system is adjusted to be 10.0 and heated to 65° C. in 30 minutes. A solution in which 14 parts of magnesium chloride hexa hydrate is dissolved in 14 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 3-2. Thereafter, Mother toner 3 is obtained in the same manner as in Example 1 except that Dispersed slurry 1-2 is replaced with Dispersed slurry 3-2. The volume average particle diameter (Dv) is 6.2 μm, the number average particle diameter (Dp) is 5.6 μm, Dv/Dp is 1.11 and the average circularity is 0.974. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 3 of the present disclosure.

Example 10

199 parts of 70% solution of ethyl acetate of Polyester 1 is added to 131 parts of Material solution 2 and stirred with a three one motor for 2 hours to obtain Oil phase 4. Ethyl acetate is added to adjust such that the density of solid portion (measured at 130° C. for 30 minutes) of Oil phase 4 is 50%.

Emulsification Process 63.5 parts of Prepolymer 1 and 1.8 parts of isophorone diamine is added to the whole amount of Oil phase 4 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 2.

Removal of Solvent

Emulsion slurry 4 is placed in a container equipped with a stirrer and a thermometer and the solvent is removed at 30° C. for 8 hours to obtain Dispersed slurry 4. The resin particulate (P-4) in the dispersed slurry has a diameter of 1.2 μm.

Thereafter, Mother toner 4 is obtained in the same manner as in Example 9 Except that Dispersed slurry 3 is replaced with Dispersed slurry 4. The volume average particle diameter (Dv) is 5.8 μm, the number average particle diameter (Dp) is 5.2 μm, Dv/Dp is 1.12 and the average circularity is 0.968. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 4 of the present disclosure.

Example 11

Emulsification Process 1.0 part of isophorone diamine is added to 270 parts of 50% ethyl acetate solution of Polyester 1 and mixed with a TK HOMOMIXER (manufactured by Tokushu Kika Kogyo Co., Ltd.) at a rotation of 5,000 rpm for one minute. 405 parts of Aqueous phase 1 is added thereto and the resultant is mixed by the TK HOMOMIXER controlling the rotation speed in the range of from 8,000 to 13,000 rpm for 20 minutes to obtain Emulsion slurry 5.

Removal of Solvent

Emulsion slurry 5 is placed in a container equipped with a stirrer and a thermometer and the solvent is removed at 30° C. for 8 hours to obtain Dispersed slurry 5. The resin particulate (P-6) in the dispersed slurry has a diameter of 0.5 μm.

Agglomeration Process of Particulate

Dispersed slurry 5 and 315 parts of Liquid dispersion of pigment 1 are added to Emulsion slurry 2 prepared in the same manner as in Example 8. pH of the system is adjusted to be 10.0 and heated to 65° C. in 30 minutes. A solution in which 16 parts of magnesium chloride hexa hydrate is dissolved in 16 parts of deionized water is added little by little while keeping the temperature at 65° C. After confirming that almost all the particulates are agglomerated, 360 parts of liquid dispersion of vinyl-based copolymer resin particulate V-1 and a solution in which 4 parts of magnesium chloride hexa hydrate is dissolved in 4 parts of deionized water is added while keeping the temperature at 65° C. After confirming that almost all the particulates are attached, aqueous solution of hydrochloric acid is added to adjust pH to be 5 and heated to 80° C. 2 hours later, the system is cooled down to obtain Dispersed slurry 5-2.

Thereafter, Mother toner 5 is obtained in the same manner as in Example 7 except that Dispersed slurry 1-2 is replaced with Dispersed slurry 5-2. The volume average particle diameter (Dv) is 6.3 μm, the number average particle diameter (Dp) is 5.7 μm, Dv/Dp is 1.11 and the average circularity is 0.978. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 5 of the present disclosure.

Example 12

Agglomeration Process of Particulate

One third of Dispersed slurry 5 and 210 parts of Liquid dispersion of pigment 1 are added to Dispersed slurry 4 prepared in the same manner as in Example 10. pH of the system is adjusted to be 10.0 and heated to 65° C. in 30 minutes. A solution in which 12 parts of magnesium chloride hexa hydrate is dissolved in 12 parts of deionized water is added little by little while keeping the temperature at 65° C. After confirming that almost all the particulates are agglomerated, 120 parts of Liquid dispersion of Vinyl-based copolymer resin particulate V-1 and a solution in which 1.5 parts of magnesium chloride hexa hydrate is dissolved in 1.5 parts of deionized water is added while keeping the temperature at 65° C. After confirming that almost all the particulates are attached, aqueous solution of hydrochloric acid is added to adjust pH to be 5 and heated to 80° C. 2 hours later, the system is cooled down to obtain Dispersed slurry 6-2.

Thereafter, Mother toner 6 is obtained in the same manner as in Example 7 except that Dispersed slurry 1-2 is replaced with Dispersed slurry 6-2. The volume average particle diameter (Dv) is 6.0 μm, the number average particle diameter (Dp) is 5.4 μm, Dv/Dp is 1.11 and the average circularity is 0.972. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 6 of the present disclosure.

Example 13

Agglomeration Process of Particulate

Dispersed slurry 5 prepared in the same manner as in Example 11 and 189 parts of Liquid dispersion of pigment 1 are added to three fifths of Dispersed slurry 2 prepared in the same manner as in Example 8. pH of the system is adjusted to be 10.0 and heated to 65° C. in 30 minutes. A solution in which 12 parts of magnesium chloride hexa hydrate is dissolved in 12 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 7-2.

Thereafter, Mother toner 7 is obtained in the same manner as in Example 7 except that Dispersed slurry 1-2 is replaced with Dispersed slurry 6-2. The volume average particle diameter (Dv) is 6.4 μm, the number average particle diameter (Dp) is 5.7 μm, Dv/Dp is 1.12 and the average circularity is 0.975. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 7 of the present disclosure.

Comparative Example 6

Synthesis of Master Batch 40 parts of carbon black (REGUL 400R, manufactured by Cabot Corporation), 60 parts of binder resin (polyester resin)

(RS-801, manufactured by Sanyo Chemical Industries, Ltd., Acid value: 10, Mw: 20,000, Tg: 64° C.) and 30 parts of water are mixed by a HENSCHEL MIXER to obtain a mixture in which water sops in pigment agglomeration body. The mixture is mixed and kneaded for 45 minutes by two rolls in which the temperature of the surface of the roll is set at 130° C. and pulverized by a pulverizer to the size of 1 mmΦ. Thus, Master batch 1 is obtained.

Manufacturing of Liquid Dispersion of Wax (Oil Phase)

The following is placed and mixed in a reaction container equipped with a stirrer and a thermometer:

| | |
|---|---|
| Polyester 1 | 50.5 parts |
| Paraffin wax (Melting point 72° C.) | 16.8 parts |
| Ethyl acetate | 201 parts |

The mixture is agitated, heated to 80° C., and kept at 80° C. for 5 hours and then cooled down to 30° C. in 1 hour. Then, 73.6 parts of Master batch 1 is added thereto. Subsequent to one hour mixing, the mixture is transferred to another vessel and the wax and the pigment are dispersed using a bead mill (ULTRAVISCOMILL from AIMEX) under the following conditions to obtain Material solution 5.

Liquid feeding speed: 1 kg/hr,

Disc rotation speed: 6 m/sec

Diameter of zirconia beads: 0.5 mm

Filling factor: 80% by volume

Repeat number of dispersion treatment: 3 times

Next, 177.5 parts of 70% solution of ethyl acetate of Polyester 1 is added to 171 parts of Material solution 5 and stirred with a three one motor for 2 hours to obtain Oil phase 5. Ethyl acetate is added to adjust such that the density of solid portion (measured at 130° C. for 30 minutes) of Oil phase 5 is 50%.

Emulsification Process 60.6 parts of Prepolymer 1 and 0.8 parts of isophorone diamine are added to the whole amount of Oil phase 5 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 8.

Removal of Solvent

Emulsion slurry 8 is placed in a container equipped with a stirrer and a thermometer and the solvent is removed at 30° C. for 8 hours to obtain Dispersed slurry 8.

Washing to Drying

Thereafter, Mother toner 8 is obtained in the same manner as in Example 7 except that Dispersed slurry 1 is replaced with Dispersed slurry 8. The volume average particle diameter (Dv) is 5.5 μm, the number average particle diameter (Dp) is 4.9 μm, Dv/Dp is 1.12 and the average circularity is 0.980. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 8.

Comparative Example 7

Manufacturing of Liquid Dispersion of Wax (Oil Phase)

The following is placed and mixed in a reaction container equipped with a stirrer and a thermometer:

| | |
|---|---|
| Polyester 1 | 75.7 parts |
| Paraffin wax (Melting point 72° C.) | 25.2 parts |
| Ethyl acetate | 250 parts |

The mixture is agitated, heated to 80° C., and kept at 80° C. for 5 hours and then cooled down to 30° C. in 1 hour. Then, 73.6 parts of Master batch 1 is added thereto. Subsequent to one hour mixing, the mixture is transferred to another vessel and the wax and the pigment are dispersed using a bead mill (ULTRAVISCOMILL from AIMEX) under the following conditions to obtain Material solution 6.

Liquid feeding speed: 1 kg/hr,

Disc rotation speed: 6 m/sec

Diameter of zirconia beads: 0.5 mm

Filling factor: 80% by volume

Repeat number of dispersion treatment: 3 times

Next, 154.4 parts of 70% solution of ethyl acetate of Polyester 1 is added to 212 parts of Material solution 6 and stirred with a three one motor for 2 hours to obtain Oil phase 6. Ethyl acetate is added to adjust such that the density of solid portion (measured at 130° C. for 30 minutes) of Oil phase 6 is 50%.

Emulsification Process 59.3 parts of Prepolymer 1 and 0.8 parts of isophorone diamine are added to the whole amount of Oil phase 6 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 9.

Thereafter, Mother toner 9 is obtained in the same manner as in Comparative Example 6 except that Dispersed slurry 8 is replaced with Dispersed slurry 9. The volume average particle diameter (Dv) is 5.7 μm, the number average particle diameter (Dp) is 5.1 μm, Dv/Dp is 1.12 and the average circularity is 0.978. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 9.

Comparative Example 8

Manufacturing of Suspension Polymerization Toner 720 parts of deionized water and 860 parts of 0.1 M sodium phosphate are placed in a container and stirred by a high speed stirrer HOMOMIXER at 15,000 rpm while keeping the temperature at 60° C. 680 parts of aqueous solution of 1 M calcium chloride is added little by little thereto. Thus, aqueous liquid dispersion containing calcium phosphate serving as fine and poor water soluble dispersion stabilizer is prepared.

The following recipe is dispersed with an attritor (manufactured by Mitsui Mineral and Smelting Co., Ltd.) for 3 hours followed by addition of 6 parts of 2,2'azobis (2,4-dimethyl valeronitrile) to prepare a monomer composition.

| | |
|---|---|
| Styrene | 154 parts |
| n-butyl acrylate | 31 parts |
| Carbon black (REGUL 400R, manufactured by Cabot Corporation) | 14 parts |
| Aluminum salicylate | 5 parts |

-continued

| | |
|---|---|
| Divinyl benzene | 0.1 parts |
| Paraffin wax (Melting point 72° C.) | 15 parts |

Next, the monomer composition is added in the aqueous liquid dispersion and stirred for 4 minutes maintaining the rotation speed of the high speed stirrer at 15,000 rpm under nitrogen atmosphere at 60° C. to granulate a monomer composition. Thereafter, the high speed stirrer is replaced with a stirrer having a paddle stirring wing. The system is maintained at 60° C. for 5 hour polymerization while stirring at 200 rpm.

Thereafter, the system is heated to 80° C. for further polymerization. Subsequent to cooling down, dilute hydrochloric acid is added to make pH 1.2 to dissolve calcium phosphate. Furthermore, after pressured filtration of solid and liquid are separated, the resultant is washed with 36,000 parts of water. The resultant is dried by a drier at 45° C. for 48 hours followed by sieving with a mesh having a mesh size of 75 μm to obtain Mother toner 10. The volume average particle diameter (Dv) is 7.9 μm, the number average particle diameter (Dp) is 6.8 μm, Dv/Dp is 1.16 and the average circularity is 0.971. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 10.

Comparative Example 9

Manufacturing of Suspension Polymerization Toner 720 parts of deionized water and 860 parts of 0.1 M sodium phosphate are placed in a container and stirred by a high speed stirrer HOMOMIXER at 15,000 rpm while keeping the temperature at 60° C. 680 parts of aqueous solution of 1 M calcium chloride is added little by little thereto. Thus, aqueous liquid dispersion containing calcium phosphate serving as fine and poor water soluble dispersion stabilizer is prepared.

The following recipe is dispersed with an attritor (manufactured by Mitsui Mineral and Smelting Co., Ltd.) for 3 hours followed by addition of 6 parts of 2,2'azobis (2,4-dimethyl valeronitrile) to prepare a monomer composition.

| | |
|---|---|
| Styrene | 23 parts |
| n-butyl acrylate | 25 parts |
| Carbon black (REGUL 400R, manufactured by Cabot Corporation) | 14 parts |
| Aluminum salicylate | 5 parts |
| Divinyl benzene | 0.1 parts |
| Polyester 1 | 37 parts |
| Paraffin wax (Melting point 72° C.) | 15 parts |

Next, the monomer composition is added in the aqueous liquid dispersion and stirred for 4 minutes maintaining the rotation speed of the high speed stirrer at 15,000 rpm under nitrogen atmosphere at 60° C. to granulate a monomer composition. Thereafter, the high speed stirrer is replaced with a stirrer having a paddle stirring wing. The system is maintained at 60° C. for 5 hour polymerization while stirring at 200 rpm.

Thereafter, the system is heated to 80° C. for further polymerization. Subsequent to cooling down, dilute hydrochloric acid is added to make pH 1.2 to dissolve calcium phosphate. Furthermore, after pressured filtration of solid and liquid are separated, the resultant is washed with 36,000 parts of water. The resultant is dried by a drier at 45° C. for 48 hours followed by sieving with a mesh having a mesh size of 75 μm to obtain Mother toner 11. The volume average particle diameter (Dv) is 8.3 μm, the number average particle diameter (Dp) is 7.1 μm, Dv/Dp is 1.17 and the average circularity is 0.969. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 11.

Comparative Example 10

Agglomeration Process of Particulate 800 parts of Vinyl-based copolymer resin particulate V-3 and 140 parts of Liquid dispersion of pigment 1 are added in a container equipped with a stirrer and a thermometer. pH of the system is adjusted to be 10.0 and heated to 65° C. in 30 minutes. A solution in which 10 parts of magnesium chloride hexa hydrate is dissolved in 10 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 12-2.

Thereafter, Mother toner 12 is obtained in the same manner as in Example 7 except that Dispersed slurry 1-2 is replaced with Dispersed slurry 12-2. The volume average particle diameter (Dv) is 6.1 μm, the number average particle diameter (Dp) is 5.4 μm, Dv/Dp is 1.13 and the average circularity is 0.965. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 12.

Comparative Example 11

Agglomeration Process of particulate

Dispersed slurry 13-2 is obtained in the same manner as in Comparative Example 10 except that Vinyl-based copolymer resin particulate V-3 is replaced with Vinyl-based copolymer resin particulate V-4.

Thereafter, Mother toner 13 is obtained in the same manner as in Example 7 except that Dispersed slurry 1-2 is replaced with Dispersed slurry 13-2. The volume average particle diameter (Dv) is 6.3 μm, the number average particle diameter (Dp) is 5.5 μm, Dv/Dp is 1.15 and the average circularity is 0.966. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 13.

Comparative Example 12

Agglomeration Process of particulate

A half of the amount of Dispersed slurry 5 prepared in the same manner as in Example 11, 1,080 parts of Vinyl-based copolymer resin particulate V-4 and 236.3 parts of Liquid dispersion of pigment 1 are added in a container equipped with a stirrer and a thermometer. pH of the system is adjusted to be 10.0 and heated to 65° C. in 30 minutes. A solution in which 15 parts of magnesium chloride hexa hydrate is dissolved in 15 parts of deionized water is added little by little while keeping the temperature at 65° C. After confirming that almost all the particulates are agglomerated, aqueous solution of hydrochloric acid is added to adjust pH to be 5 and heated to 80° C. 2 hours later, the system is cooled down to obtain Dispersed slurry 14-2.

Thereafter, Mother toner 12 is obtained in the same manner as in Example 7 except that Dispersed slurry 1-2 is replaced with Dispersed slurry 14-2. The volume average particle diameter (Dv) is 6.4 μm, the number average particle diameter (Dp) is 5.6 μm, Dv/Dp is 1.14 and the average circularity is 0.967. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 14.

Comparative Example 13

Manufacturing of Liquid Dispersion of Wax (Oil Phase)

Oil phase is prepared in the same manner as in Example 7.

Emulsification Process 2.0 parts of isophorone diamine is added to the whole amount of Oil phase 1 and mixed with a TK HOMOMIXER (manufactured by Tokushu Kika Kogyo Co., Ltd.) at a rotation of 5,000 rpm for one minute. 675 parts of Aqueous phase 1 is added thereto and the resultant is mixed by the TK HOMOMIXER controlling the rotation speed in the range of from 8,000 to 13,000 rpm for 20 minutes to obtain Emulsion slurry 15.

Removal of Solvent

Emulsion slurry 15 is placed in a container equipped with a stirrer and a thermometer and the solvent is removed at 30° C. for 8 hours to obtain Dispersed slurry 15. The resin particulate (P-5) in the dispersed slurry has a diameter of 0.5 μm.

Dispersed slurry 15-2 is obtained in the same manner as in Example 7 except that Dispersed slurry 1 is replaced with Dispersed slurry 15.

Thereafter, Mother toner 15 is obtained in the same manner as in Example 7 except that Dispersed slurry 1-2 is replaced with Dispersed slurry 15-2. The volume average particle diameter (Dv) is 6.4 μm, the number average particle diameter (Dp) is 5.7 μm, Dv/Dp is 1.12 and the average circularity is 0.970. 0.5 parts of hydrophobic silica having a primary particle diameter of about 30 μm and 0.5 parts of hydrophobic silica having a primary particle diameter of about 10 μm are mixed with 100 parts of Mother toner by a HENSCHEL MIXER to obtain Developing agent 15.

Physicality and evaluation on each developing agent are shown in Tables 2 and 3.

TABLE 2

| | Resin particulate | | |
|---|---|---|---|
| | Resin component | Particle diameter | Content of wax (% by weight) |
| P-1 | Polyester | 1.3 | 8 |
| P-2 | Polyester (containing modified polyester) | 1.5 | 8 |
| P-3 | Polyester | 1.1 | 6 |
| P-4 | Polyester (containing modified polyester) | 1.2 | 6 |
| P-5 | Polyester | 0.5 | 8 |
| P-6 | Polyester | 0.5 | — |
| V-1 | Vinyl-based | 0.05 | — |
| V-2 | Vinyl-based | 0.08 | — |
| V-3 | Vinyl-based | 0.2 | 6 |
| V-4 | Vinyl-based | 0.2 | 10 |

TABLE 3

| | | Resin composition | | | | | | Toner particle diameter | | | Form | | Evaluation | | | | |
|---|---|---|---|---|---|---|---|---|---|---|---|---|---|---|---|---|---|
| | DA | FR | Wt % | OR1 | Wt % | OR2 | Wt % | DV | Dn | Dv/Dn | CR | WE | CH | AS | IF | FS | HT |
| Ex 7 | 1 | P-1 | 60 | V-1 | 40 | — | — | 6.1 | 5.5 | 1.11 | 0.973 | 8.5 | G | E | G | E | G |
| Ex 8 | 2 | P-2 | 55 | V-2 | 45 | — | — | 5.9 | 5.3 | 1.11 | 0.971 | 8.4 | E | G | G | G | E |
| Ex 9 | 3 | P-3 | 75 | V-1 | 25 | — | — | 6.2 | 5.6 | 1.11 | 0.974 | 7.7 | G | G | G | E | G |
| Ex 10 | 4 | P-4 | 75 | V-1 | 25 | — | — | 5.8 | 5.2 | 1.12 | 0.968 | 7.5 | G | G | G | E | G |
| Ex 11 | 5 | P-2 | 50 | P-6 | 30 | V-1 | 20 | 6.3 | 5.7 | 1.11 | 0.978 | 7.3 | E | E | E | G | E |
| Ex 12 | 6 | P-4 | 75 | P-6 | 15 | V-1 | 10 | 6.0 | 5.4 | 1.11 | 0.972 | 7.8 | E | G | E | G | E |
| Ex 12 | 7 | P-2 | 50 | P-6 | 50 | — | — | 6.4 | 5.7 | 1.12 | 0.975 | 7.2 | F | G | G | E | G |
| CX 6 | 8 | No particulate is used | | | | | | 5.5 | 4.9 | 1.12 | 0.980 | 7.3 | F | G | F | E | F |
| CX 7 | 9 | No particulate is used | | | | | | 5.7 | 5.1 | 1.12 | 0.978 | 10.8 | F | G | B | E | B |
| CX 8 | 10 | No particulate is used | | | | | | 7.9 | 6.8 | 1.16 | 0.971 | 15.1 | E | G | G | B | G |
| CX 9 | 11 | No particulate is used | | | | | | 8.3 | 7.1 | 1.17 | 0.969 | 14.9 | G | G | F | B | G |
| CX 10 | 12 | V-3 | 100 | — | — | — | — | 6.1 | 5.4 | 1.13 | 0.965 | 9.8 | G | F | G | B | B |
| CX 11 | 13 | V-4 | 100 | — | — | — | — | 6.3 | 5.5 | 1.15 | 0.966 | 16.2 | G | B | B | F | B |
| CX 12 | 14 | V-4 | 50 | P-6 | 20 | — | — | 6.4 | 5.6 | 1.14 | 0.967 | 14.2 | F | B | F | G | B |
| CX 13 | 15 | P-5 | 50 | V-1 | 50 | — | — | 6.4 | 5.7 | 1.12 | 0.970 | 6.8 | G | G | E | F | F |

EX: Example
CX: Comparative Example
DA: Developing agent
FR: First resin particulate
OR: Other resin particulate
CR: Circularity
WE: Wax endothermic amount (mJ/mg)
CH: Chargeability
AS: Anti-stress
IF: Image fouling
FS: Fixing separation
HT: High temperature preservability As seen in the results of the evaluation, good results are obtained in Examples and no contamination caused by wax is observed and image fouling is few. Furthermore, with regard to fixing separation, the result is satisfactory and image durability in a low temperature range is sufficient. The fixing property of the toner of Comparative Examples 6 and 7 is excellent but image fouling caused by member contamination is significantly observed. This may be related with the direct granulation method. In addition, with regard to the toner of Comparative Examples 8 and 9, wax may not sufficiently ooze so that offset is considerably observed in fixing evaluation and fixing separation property is not secured. The toner of Comparative Examples 10, 11 and 12 have a problem with high temperature preservability in particular. The toner of Comparative Example 13 in which P-5 having a small particle diameter is used as the first resin particulate is not satisfactory with regard to offset in a high temperature range in particular in the fixing evaluation.

As can be seen in Examples, the toner of the present disclosure has an excellent chargeability and durability and a good combination of low temperature fixing property and high temperature preservability. Thus, the toner has a fixing performance which can deal with full color high speed printing.

This document claims priority and contains subject matter related to Japanese Patent Applications No. 2006-250885 and 2006-251885, both filed on Sep. 15, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed is:

1. A toner comprising:
toner particles comprising:
a binder resin;
a coloring agent; and
a wax, and
further comprising a surface layer comprising an amorphous polymer,
wherein the toner particles are prepared by at least one of agglomeration and fusion of at least two kinds of resin particulates and particles of the coloring agent dispersed in an aqueous medium,
wherein a first resin particulate, among the at least two kinds of resin particulates including a second resin particulate, comprises a resin having a polyester skeleton and the wax,
wherein at least 50% by weight of the binder resin is polyester resins, and
wherein the first resin particulate is manufactured by dissolving a first polyester resin and the wax in a vinyl-based monomer, dispersing the solution in an aqueous medium comprising a surface active agent and polymerizing the vinyl-based monomer by a polymerization initiator, and a second resin particulate among the at least two kinds of resin particulates is a second polyester resin.

2. The toner according to claim 1, wherein the first polyester resin has a polymerizable double bond.

3. The toner according to claim 1, wherein at least one of the first polyester resin and the second polyester resin has a crystalline polyester.

4. The toner according to claim 1, wherein the first resin particulate is prepared by dispersing the wax in a solution in which at least the resin having the polyester skeleton is dissolved in an organic solvent and suspending the resultant liquid dispersion in an aqueous medium.

5. The toner according to claim 1, wherein the wax is a hydrocarbon wax.

6. The toner according to claim 1, wherein the first resin particulate has a volume average particle diameter greater than 1 μm and an endothermic amount measured by a differential scanning calorimeter (DSC) is 7.3 to 8.5 mJ/mg based on heat of fusion of the wax.

7. The toner according to claim 1, wherein a domain of the wax has a stick form or a disk form.

8. The toner according to claim 1, wherein the toner has an average circularity of not less than 0.965.

9. The toner according to claim 1, wherein the resin particulates other than the first resin particulate have a volume average particle diameter of not greater than 0.2 μm.

10. The toner according to claim 1, wherein the toner has a core-shell structure in which the resin particulates other than the first resin particulate cover a surface of the toner.

11. The toner according to claim 1, wherein after at least one of agglomeration and fusion of the at least two kinds of resin particulates dispersed in an aqueous medium to obtain a particle, the resin particulates other than the first resin particulate are subjected to at least one of agglomeration and fusion on the particle.

12. The toner according to claim 1, wherein the first resin particulate comprises a modified polyester resin having at least one of a urethane group and a urea group.

13. The toner according to claim 1, wherein one or more of the polyester resins comprises a modified polyester resin at least one of elongated and cross-linked according to a reaction between a modified polyester resin having an isocyanate group at an end thereof and an amine.

14. A toner comprising:
toner particles comprising:
a binder resin;
a coloring agent; and
a wax, and
further comprising a surface layer comprising an amorphous polymer,
wherein the toner particles are prepared by at least one of agglomeration and fusion of at least two kinds of resin particulates and particles of the coloring agent dispersed in an aqueous medium,
wherein a first resin particulate, among the at least two kinds of resin particulates including a second resin particulate, comprises a resin having a polyester skeleton and the wax,
wherein at least 50% by weight of the binder resin is polyester resins, and
wherein the at least two kinds of resin particulates comprises a vinyl-based polymer resin.

15. A toner comprising:
toner particles comprising:
a binder resin;
a coloring agent; and
a wax, and
further comprising a surface layer comprising an amorphous polymer,
wherein the toner particles are prepared by at least one of agglomeration and fusion of at least two kinds of resin particulates and particles of the coloring agent dispersed in an aqueous medium,
wherein a first resin particulate, among the at least two kinds of resin particulates including a second resin particulate, comprises a resin having a polyester skeleton and the wax,
wherein at least 50% by weight of the binder resin is polyester resins, and
wherein an interface between the wax and the binder resin comprises a mixture area of one or more of the polyester resins and a styrene-acrylic resin.

* * * * *